US010938139B2

(12) United States Patent
Rossman et al.

(10) Patent No.: US 10,938,139 B2
(45) Date of Patent: Mar. 2, 2021

(54) ELECTRICAL CONNECTOR WITH RETRACTABLE CONTACTS

(71) Applicant: TE CONNECTIVITY CORPORATION, Berwyn, PA (US)

(72) Inventors: Jared Evan Rossman, Dover, PA (US); Christopher William Blackburn, Bothell, WA (US); Richard Elof Hamner, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 46 days.

(21) Appl. No.: 16/107,070

(22) Filed: Aug. 21, 2018

(65) Prior Publication Data

US 2020/0067225 A1 Feb. 27, 2020

(51) Int. Cl.

| | |
|---|---|
| ***H01R 13/24*** | (2006.01) |
| ***H01R 13/17*** | (2006.01) |
| ***H01R 13/6593*** | (2011.01) |
| ***H01R 12/71*** | (2011.01) |
| ***H01R 24/86*** | (2011.01) |

(52) U.S. Cl.

CPC ..... *H01R 13/2421* (2013.01); *H01R 12/716* (2013.01); *H01R 13/17* (2013.01); *H01R 13/6593* (2013.01); *H01R 24/86* (2013.01)

(58) Field of Classification Search

CPC ..... H01R 13/2421; H01R 13/17; H01R 13/6593; H01R 12/716; H01R 24/86; H01R 13/658; H01R 13/6585; H01R 13/6586; H01R 24/84; H01R 13/22; H01R 11/18

USPC ..... 439/700, 284, 289, 607.05, 607.23, 824

See application file for complete search history.

(56) References Cited

U.S. PATENT DOCUMENTS

| | | | | |
|---|---|---|---|---|
| 5,417,595 | A * | 5/1995 | Cullen | H01R 13/2421 439/700 |
| 6,551,126 | B1 * | 4/2003 | Feldman | G01R 1/06772 324/755.05 |
| 6,824,427 | B1 * | 11/2004 | Feldman | G01R 31/2887 439/578 |
| 6,910,897 | B2 | 6/2005 | Driscoll et al. | |
| 7,740,508 | B2 * | 6/2010 | Feldman | G01R 31/2889 324/755.02 |
| 9,735,519 | B2 * | 8/2017 | Yi | H01R 9/05 |
| 10,476,196 | B2 * | 11/2019 | Venaleck | H01R 13/514 |
| 10,498,061 | B1 * | 12/2019 | Blasick | H01R 13/08 |
| 2009/0176410 | A1 * | 7/2009 | Tutt | H01R 13/6586 439/607.05 |
| 2016/0104956 | A1 * | 4/2016 | Santos | H01R 13/2414 324/754.03 |

* cited by examiner

*Primary Examiner* — Travis S Chambers

(57) ABSTRACT

An electrical connector includes a housing, electrical signal contacts, and biasing elements. The signal contacts are terminated to one or more electrical cables. The signal contacts are held by one or more contact units within the housing. The signal contacts are movable relative to the housing between an extended position and a retracted position. The retracted position is disposed closer to a back end of the housing than the extended position. The biasing elements are configured to bias the signal contacts toward the extended position. The signal contacts are pins with an end face at a distal end of each respective pin. The end faces of the signal contacts are configured to abut against end faces of corresponding mating signal contacts of a mating connector.

22 Claims, 14 Drawing Sheets

ELECTRICAL CONNECTOR WITH RETRACTABLE CONTACTS

BACKGROUND OF THE INVENTION

The subject matter herein relates generally to electrical connectors for establishing electrically conductive pathways between devices.

Electrical connector systems include complementary electrical connectors that removably couple together to provide an electrically conductive pathway across the connectors. The conductive pathway is defined along electrical contacts of the connectors that engage one another at a mating interface. Typical electrical connectors are designed such that the electrical contacts slide and wipe against one another as the two connectors are moved towards each other during the mating process. These electrical connectors may experience signal transmission problems, particularly at high data transfer rates. For example, the wipe-based contacts may form stub portions that are defined along the length of the contacts from the contact location or interface (where the respective contact engages the mating contact) to a distal end of the contact. Electrical energy (e.g., resonance) may propagate along the stub portions, reflecting back and forth along the lengths of the contacts and degrading high speed signals.

Another problem associated with known connectors is impedance changes which may occur at several locations along the length of the signal pathway. The impedance changes occur in response to variances in the material properties and/or dimensions of the conductors and the dielectric material surrounding the conductors. The impedance changes may degrade the signals by causing a portion of the electrical energy of the signals to reflect and/or be absorbed instead of being transmitted along the signal pathway to the destination.

A need remains for an electrical connector that avoids the formation of stub portions along the electrical contacts and reduces impedance changes to enable high speed signal transmission and increased contact density with reduced signal attenuation relative to known electrical connectors.

BRIEF DESCRIPTION OF THE INVENTION

In one or more embodiments, an electrical connector is provided that includes a housing, electrical signal contacts, and biasing elements. The housing extends from a mating end to a back end of the housing. The signal contacts are terminated to one or more electrical cables that project from the back end of the housing. The signal contacts are held by one or more contact units within the housing. The signal contacts are movable relative to the housing between an extended position and a retracted position. The retracted position is disposed closer to the back end of the housing than the extended position. The biasing elements are configured to bias the signal contacts toward the extended position. The signal contacts are pins with an end face at a distal end of each respective pin. The end faces of the signal contacts are configured to abut against end faces of corresponding mating signal contacts of a mating connector.

In one or more embodiments, an electrical connector is provided that includes a housing, electrical signal contacts arranged in pairs, electrical ground contacts, and biasing elements. Each pair of the signal contacts is terminated to core conductors of a different one of multiple electrical cables projecting from the housing. The pairs of signal contacts are organized in an array including multiple columns. The electrical ground contacts are held within the housing. The signal contacts and the ground contacts are movable relative to the housing between an extended position and a retracted position. The retracted position is disposed closer to a back end of the housing than the extended position. The biasing elements are configured to bias the signal contacts and the ground contacts toward the extended position. The signal contacts and the ground contacts are pins that have an end face at a distal end of each respective pin. The end faces of the signal contacts are configured to abut against end faces of corresponding mating signal contacts of a mating connector. The end faces of the ground contacts are configured to abut against end faces of corresponding mating ground contacts of the mating connector.

In one or more embodiments, an electrical connector is provided that includes a housing, electrical signal contacts, and biasing elements. The signal contacts are arranged in pairs and held by one or more contact units within the housing. The one or more contact units include multiple dielectric bodies and one or more conductive shield members. Each of the dielectric bodies surrounds a different one of the pairs of the signal contacts. Each of the one or more conductive shield members surrounds at least one of the dielectric bodies. The signal contacts are movable relative to the housing between an extended position and a retracted position. The retracted position is disposed closer to a back end of the housing than the extended position. The biasing elements are configured to bias the signal contacts toward the extended position. The signal contacts are pins with an end face at a distal end of each respective pin. The end faces of the signal contacts are configured to abut against end faces of corresponding mating signal contacts of a mating connector.

DETAILED DESCRIPTION OF THE INVENTION

Embodiments of the present disclosure provide an electrical connector that has retractable contacts. The retractable contacts include signal contacts and may also include ground contacts. The retractable contacts are pins that have end faces at distal ends of the pins. When the electrical connector is coupled or mated to a complementary mating connector, the end faces of the pins are configured to abut against end faces of corresponding mating contacts of the mating connector to establish an electrical connection across a mating interface of the two connectors. The face-to-face engagement of the contact pins of the two connectors avoids the formation of stub portions along the contacts because there is no portion of the pins that extends beyond the contact interface and is outside of the signal pathway. For example, because the distal ends of the pins abut one another at the contact interface, there is no length of the contacts that extends from the contact interface to the distal end. The retractable property of the contacts allows the contacts to axially float or retract at least slightly during the mating process which allows the contacts of the two connectors to reliably engage without stubbing. At least one technical effect of the embodiments of the electrical connector disclosed herein is reduced signal attenuation (e.g., degradation) relative to known electrical connectors due to reduced electrical resonances attributable to the avoidance of contact stub portions.

In one or more embodiments of the present disclosure, the electrical connector is mounted to one or more electrical cables. The retractable contacts that represent signal contacts may be electrically terminated (e.g., electrically connected and mechanically engaged) to corresponding conductors of the one or more electrical cables. The signal contacts may be surrounded by dielectric overmold material that is sized and/or shaped according to the size and/or shape of an insulation layer of the electrical cables. The dielectric overmold material may engage the insulation layer of the cables, such that the dielectric overmold material functions as an extension of the insulation layer. At least one technical effect of the embodiments of the electrical connector disclosed herein may be reduced signal attenuation (e.g., degradation) relative to known electrical connectors due to fewer and/or less extensive impedance changes along the length of the electrically conductive signal paths. Due to the reduced signal attenuation attributable to the avoidance of contact stub portions and/or fewer impedance changes, the electrical connector may be able to convey electrical signals at greater signal transmission rates and quality, and/or may be able to have a greater contact density than known electrical connectors.

Figure 1:
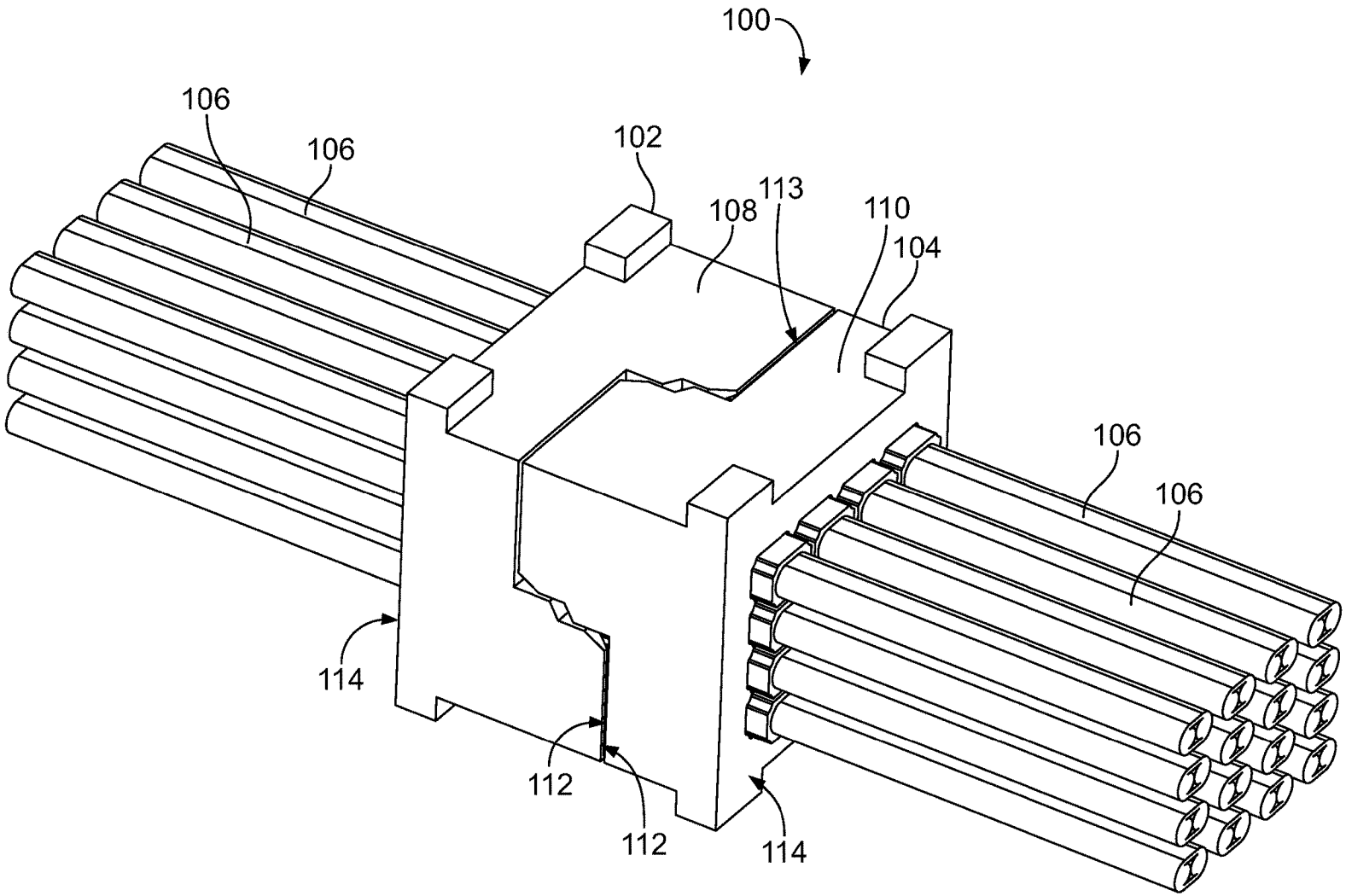
FIG. 1 is a perspective view of a connector system including a first electrical connector and a second electrical connector according to an embodiment.

FIG. 1 is a perspective view of a connector system 100 including a first electrical connector 102 and a second electrical connector 104 according to an embodiment. The first and second electrical connectors 102, 104 are complementary to one another and are mated to each other in the illustrated embodiment. The connector system 100 includes the electrical connectors 102, 104 and a plurality of electrical cables 106. Both of the connectors 102, 104 are cable-mounted connectors such that multiple cables 106 protrude from each of the connectors 102, 104. Although only segments of the cables 106 are shown in FIG. 1, the cables 106 may extend from the connectors 102, 104 to other electrical devices, such as circuit boards, other connectors, or the like.

The first and second connectors 102, 104 have respective housings 108, 110 that engage one another and define a mating interface 113. In the illustrated embodiment, the housing 108 of the first connector 102 is a replica or copy (e.g., the same size and shape) of the housing 110 of the second connector 104. The housings 108, 110 are hermaphroditic because the housings 108, 110 are designed to enable mating to replicas. For example, each of the housings 108, 110 has a mating end 112 and a back end 114 opposite the mating end 112. The electrical cables 106 project from the back end 114. The mating ends 112 of the two housing 108, 110 face one another when mated and define the mating interface 113. The mating ends 112 of the housings 108, 110 are non-planar and corrugated with extended portions and cut-out areas in the illustrated embodiment to allow for hermaphroditic coupling. In one or more embodiments, the first and second connectors 102, 104 may be the same or at least similar to each other, having the same housings 108, 110 as described above and the same type and number of electrical cables 106 projecting from the housings 108, 110. Therefore, descriptions herein related to the first electrical connector 102 may also be applicable to the second connector 104. In an alternative embodiment, the housing 108 of the first connector 102 is different than the housing 110 of the second connector 104. For example, the housing 108 may be a plug housing that is configured to be received within a socket defined in the housing 110, which represents a receptacle housing.

Figure 2:
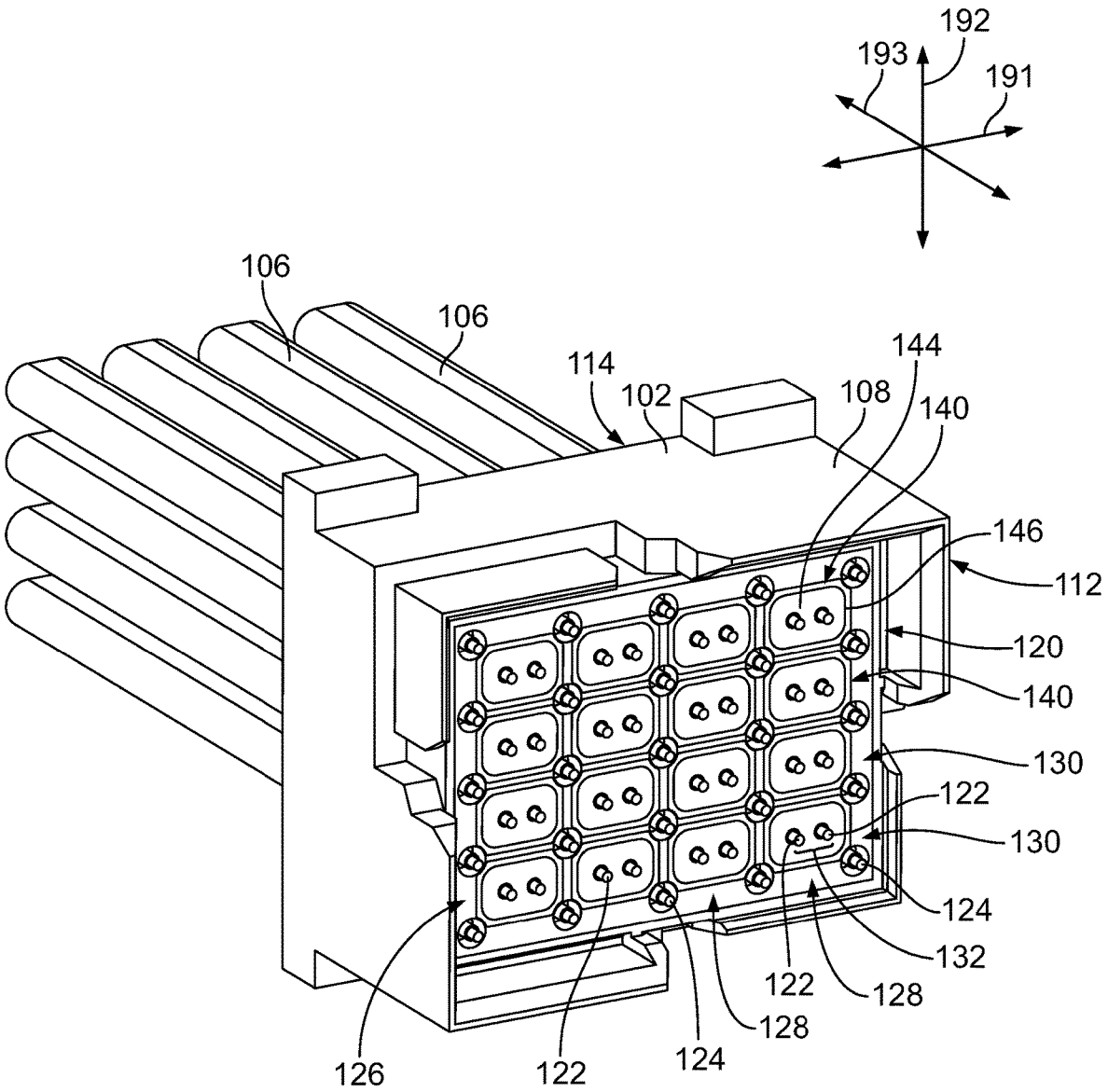
FIG. 2 is a perspective view of the first electrical connector of the connector system according to an embodiment.

FIG. 2 is a perspective view of the first electrical connector 102 of the connector system 100 (shown in FIG. 1) according to an embodiment. The housing 108 of the first electrical connector 102 (referred to herein as electrical connector 102) defines a cavity 120 that extends through the housing 108 from the mating end 112 to the back end 114. The electrical cables 106 may extend into the cavity 120 at the back end 114. In addition to the housing 108, the electrical connector 102 includes electrical contacts that are disposed within the cavity 120. The electrical contacts include signal contacts 122 and ground contacts 124. The signal contacts 122 are electrically terminated (e.g., mechanically engaged and electrically connected) to core conductors 202 (shown in FIG. 4) of the electrical cables 106. Portions of the signal contacts 122 and the ground contacts 124 are exposed within the cavity 120 at or proximate to the mating end 112 of the housing 108 for engaging corresponding mating contacts of a mating electrical connector, such as the electrical connector 104 shown in FIG. 1.

The electrical connector 102 is oriented with respect to a lateral axis 191, a height axis 192, and a longitudinal axis 193. The axes 191-193 are mutually perpendicular. Although the height axis 192 appears to extend in a vertical direction parallel to gravity in FIG. 2, it is understood that the axes 191-193 are not required to have any particular orientation with respect to gravity. The longitudinal axis 193 represents a mating axis because the electrical connector 102 mates to the mating connector 104 by moving the connectors 102, 104 towards each other along the longitudinal axis 193.

In one or more embodiments, the signal contacts 122 and the ground contacts 124 are retractable pins that are movable within the cavity 120 relative to the housing 108. For example, the signal and ground contacts 122, 124 may be movable along the longitudinal axis 193 between an extended position and a retracted position. The contacts 122, 124 are shown in the extended position. When in the retracted position, the contacts 122, 124 are disposed closer to the back end 114 of the housing 108 than in the extended position. The signal contacts 122 and ground contacts 124 may be individually retractable (and able to move independently of one another) or collectively retractable in one or more groups. The electrical connector 102 also include biasing elements 204 (shown in FIG. 4) that apply a biasing force that urges the contacts 122, 124 towards the extended position.

In the illustrated embodiment, the signal contacts 122 are organized in an array 126 that includes multiple columns 128 and rows 130. The columns 128 may be perpendicular to the rows 130. The columns 128 are parallel to the height axis 192, and the rows 130 are parallel to the lateral axis 191 in FIG. 2, but the orientations of the columns 128 and rows 130 may be switched in an alternative embodiment. The signal contacts 122 are arranged in pairs 132 to convey differential signals. The two signal contacts 122 in each pair 132 are disposed adjacent to one another within the same column 128 and row 130. Each pair 132 may be electrically connected to core conductors 202 (shown in FIG. 4) of a different one of the electrical cables 106. In the illustrated embodiment, the electrical connector 102 includes four columns 128 and four rows 130 of the pairs 132, representing thirty-two total signal contacts 122, but the electrical connector 102 may have more or less signal contacts 122 and/or different arrangements of the signal contacts 122 in other embodiments.

The signal contacts 122 are held by one or more contact units 140 of the electrical connector 102. The contact units 140 surround the signal contacts 122 to secure the positioning of the signal contacts 122 in the array 126. For example, the contact units 140 retain the signal contacts 122 within the cavity 120 and restrict movement of the signal contacts 122 except movement along the longitudinal axis 193 between the retracted position and the extended position. In the illustrated embodiment, the electrical connector 102 includes a plurality of contact units 140 spaced apart from each other within the array 126. Each of the contact units 140 surrounds and holds a different pair 132 of signal contacts 122. Thus, the contact units 140 are arranged adjacent each other in the columns 128 and the rows 130. Each contact unit 140 includes a respective dielectric body 144 and a respective conductive shield member 146 that surrounds the dielectric body 144. Therefore, the electrical connector 102 in the illustrated embodiment has multiple dielectric bodies 144 and multiple conductive shield members 146.

Figure 3:
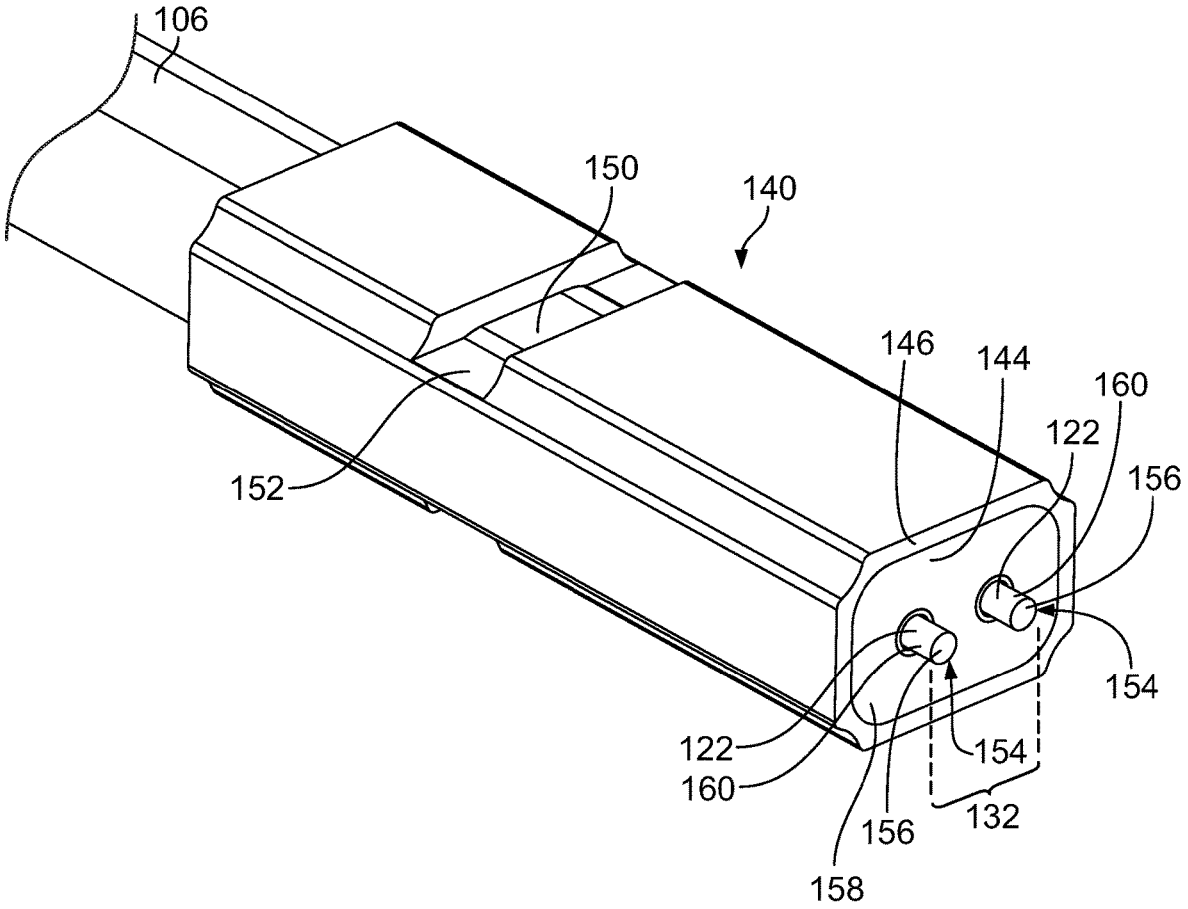
FIG. 3 is a perspective view of a contact unit of the first electrical connector shown in FIG. 2 and a segment of an electrical cable according to an embodiment.

FIG. 3 is a perspective view of one of the contact units 140 of the electrical connector 102 shown in FIG. 2 and a segment of one of the electrical cables 106 according to an embodiment. The dielectric body 144 of the contact unit 140 surrounds a pair 132 of the signal contacts 122. For example, a portion of the dielectric body 144 is disposed between the two signal contacts 122 to separate the signal contacts 122 from each other. The dielectric body 144 includes an electrically insulative material, such as one or more plastics. In a non-limiting example, the dielectric body 144 may include a Polytetrafluoroethylene (PTFE) based plastic. The dielectric body 144 may be overmolded onto the pair 132 of signal contacts 122. For example, the dielectric body 144 may be formed via a molding process by injecting the insulative material, while in a liquid phase, into a mold that includes the pair 132 of signal contacts 122, and allowing the insulative material to solidify around the signal contacts 122.

The conductive shield member 146 surrounds the dielectric body 144. The conductive shield member 146 includes an electrically conductive material. For example, the electrically conductive material may be an intrinsically conducting polymer (ICP) material, a lossy dielectric material having a dielectric substrate impregnated with metal particles, a metal material, or the like. An ICP material and a lossy dielectric material are moldable and have conductive properties without requiring a discrete metal layer. In the illustrated embodiment, the conductive shield member 146 is either an ICP material or a lossy dielectric material, and the conductive shield member 146 is formed via overmolding onto the dielectric body 144. The conductive shield member 146 may also extend over and surround a segment of the electrical cable 106 to secure the contact unit 140 to the cable 106. The conductive shield member 146 may engage a shield layer 150 of the electrical cable 106 to electrically common the conductive shield member 146 and the shield layer 150. A portion of the shield layer 150 is visible through a cutout groove 152 in the conductive shield member 146. The cutout groove 152 may be utilized to secure the contact unit 140 in place within the cavity 120 (shown in FIG. 2) of the housing 108 (FIG. 2).

The signal contacts 122 are pins that extend to distal ends 154. The signal contacts 122 have end faces 156 at the distal ends 154 of the pins. The end faces 156 are configured to abut against end faces 314 (shown in FIG. 9) of mating signal contacts 222 of the mating connector 104 (FIG. 9) when mated to establish an electrically conductive signal path across the connectors 102, 104. The signal contacts 122 are in the extended position in FIG. 3. In the illustrated embodiment, exposed segments 160 of the signal contacts 122 protrude beyond a front face 158 of the contact unit 140 to the distal ends 154. The exposed segments 160 are not surrounded by the contact unit 140. In an alternative embodiment, when the signal contacts 122 are in the extended position the distal ends 154 may be aligned with the front face 158 of the contact unit 140 or recessed relative to the front face 158.

As used herein, relative or spatial terms such as "front," "back" "rear", "upper," "lower," "interior," and "exterior," are only used to identify and distinguish the referenced elements in the illustrated orientations and do not necessarily require particular positions or orientations relative to gravity and/or the surrounding environment of the electrical connector 102 or the connector system 100.

Figure 4:
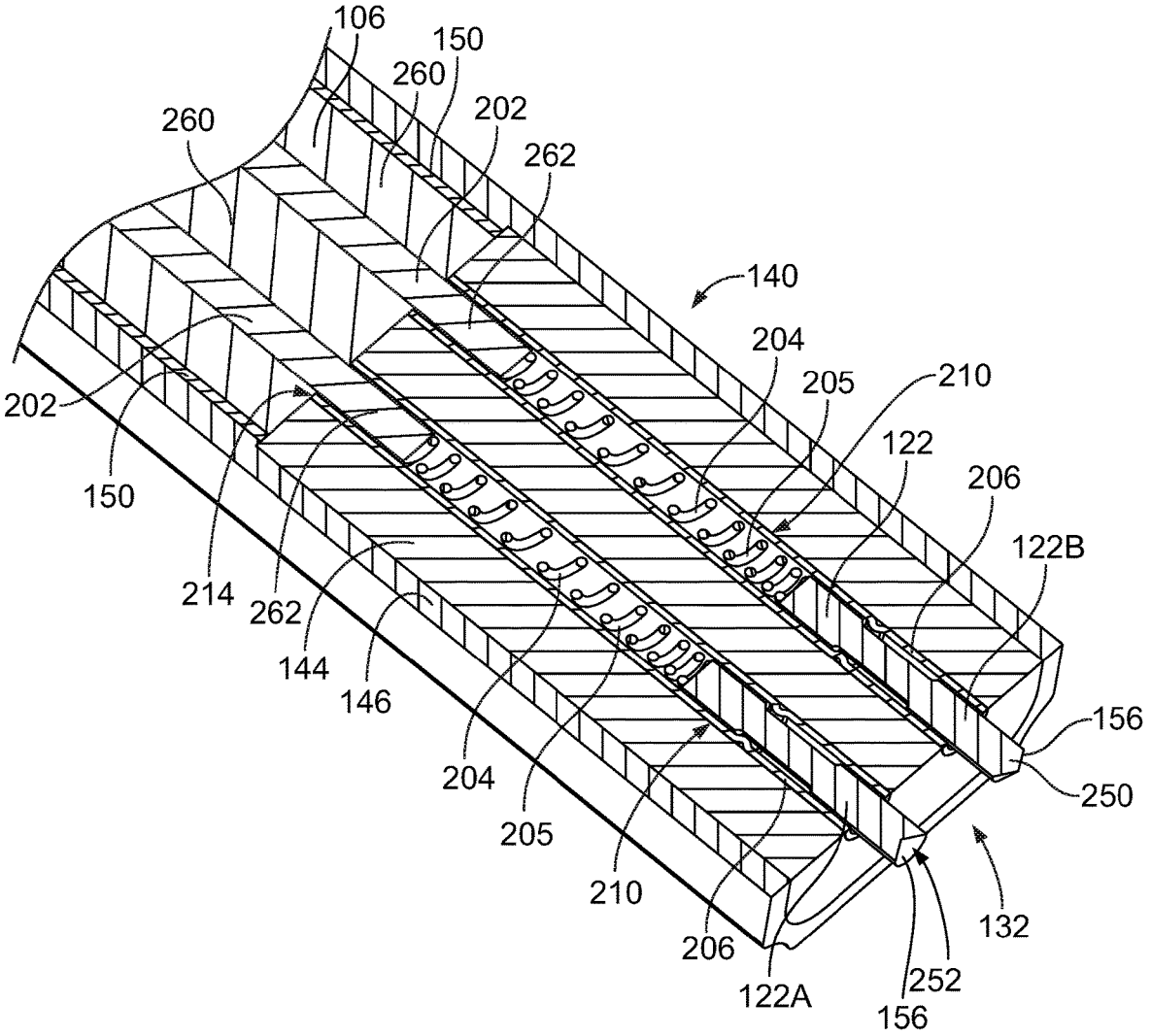
FIG. 4 is a perspective cross-sectional view of the contact unit and signal contacts shown in FIG. 3.

FIG. 4 is a perspective cross-sectional view of the contact unit 140 and the signal contacts 122 shown in FIG. 3. Each of the signal contacts 122 of the pair 132 is held within a corresponding tube 206. The signal contacts 122 move between the extended and retracted positions within the corresponding tubes 206. Each of the tubes 206 also contains a respective biasing element 204. The biasing element 204 exerts a biasing force that forces the corresponding signal contact 122 towards the extended position. In the illustrated embodiment, the biasing elements 204 are coil springs 205. The signal contacts 122 in the pair 132 include a first contact 122A and a second contact 122B. The use of discrete tubes 206 and coil springs 205 enables the first and second contacts 122A, 122B to be individually and independently movable between the extended and retracted positions. Each tube 206, including the coil spring 205 and the signal contact 122 therein, represents a contact sub-assembly 210. The contact unit 140 in the illustrated embodiment holds two contact sub-assemblies 210.

Figure 5:
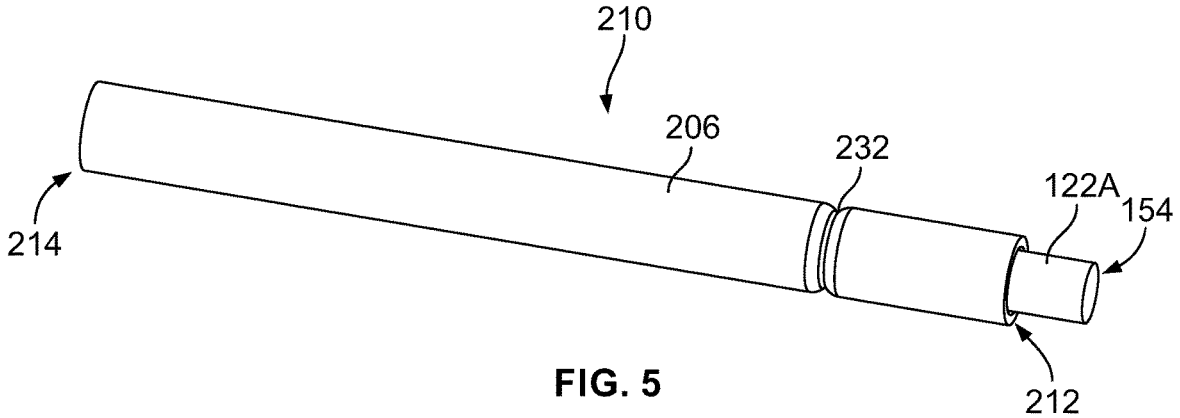
FIG. 5 is an isolated perspective view of a contact sub-assembly that includes a first signal contact according to an embodiment.
Figure 6:
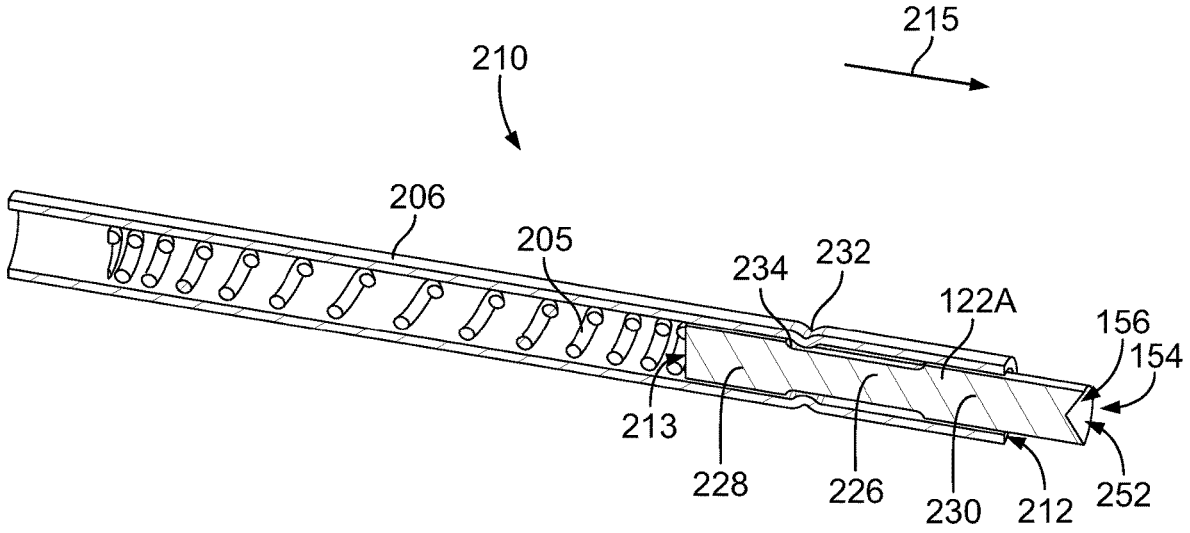
FIG. 6 is an isolated cross-sectional view of the contact sub-assembly shown in FIG. 5, with the first signal contact in an extended position.
Figure 7:
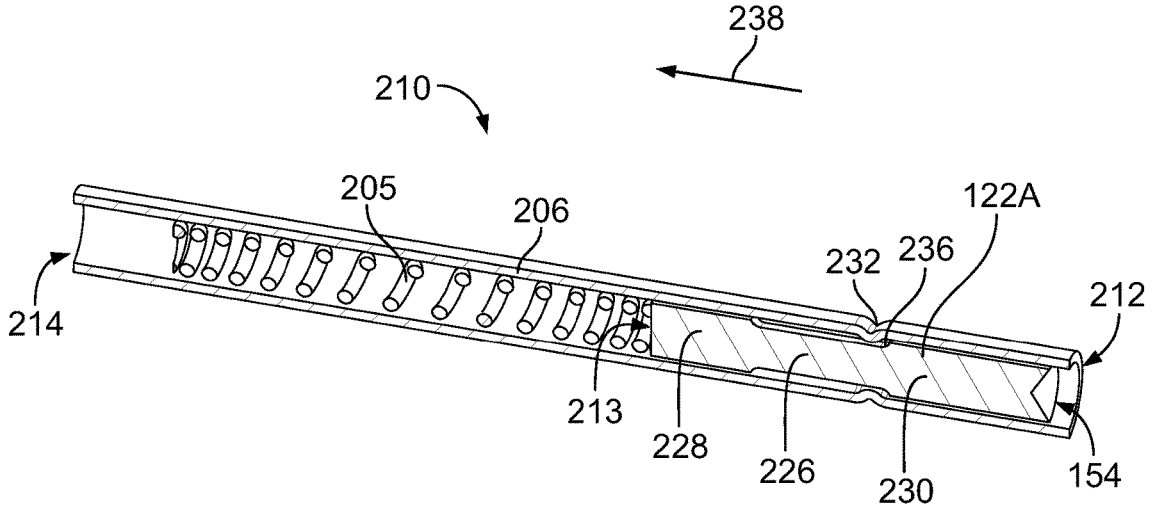
FIG. 7 is an isolated cross-sectional view of the contact sub-assembly shown in FIGS. 5 and 6, with the first signal contact in a retracted position.

FIG. 5 is an isolated perspective view of the contact sub-assembly 210 that includes the first contact 122A according to an embodiment. FIG. 6 is an isolated cross-sectional view of the contact sub-assembly 210 shown in FIG. 5, with the first contact 122A in the extended position. FIG. 7 is an isolated cross-sectional view of the contact sub-assembly 210 shown in FIGS. 5 and 6, with the first contact 122A in the retracted position.

With reference to FIG. 5, the tube 206 has a generally cylindrical shape that extends from a front end 212 to a rear end 214. The tube 206 is hollow along the entire length of the tube 206. The signal contact 122A is held at the front end 212 of the tube 206, and the distal end 154 of the signal contact 122A projects beyond the front end 212. The tube 206 may be electrically conductive. At least some electrical energy (e.g., current) may be conveyed along the tube 206 between the signal contact 122A and the electrical cable 106 (shown in FIG. 4).

Referring now to FIGS. 6 and 7, the signal contact 122A has a proximal end 213 opposite the distal end 154. The coil spring 205 is rearward of the signal contact 122A within the tube 206 and engages the proximal end 213 of the signal contact 122A. The coil spring 205 applies a biasing force on the signal contact 122A in a forward direction 215 (e.g., parallel to the axis of the tube 206) towards the extended position. Alternatively, the coil spring 205 may indirectly force the signal contact 122A, without direct engagement via an intervening member, such as a spacer.

The signal contact 122A in the illustrated embodiment has an hourglass or dog bone shape with a narrow section 226 between a first broad section 228 and a second broad section 230. The first broad section 228 includes the proximal end 213. The second broad section 230 includes the distal end 154. The tube 206 has an indentation 232 that aligns with the narrow section 226 of the signal contact 122A. The indentation 232 has a reduced diameter relative to the diameter of the tube 206 on either side of the indentation 232, as also shown in FIG. 5. The indentation 232 may be formed via crimping or otherwise compressing the tube 206 using a tool to create a dip or dent along the length of the tube 206. The diameter of the tube 206 at the indentation 232 is greater than the diameter of the narrow section 226 of the signal contact 122A, and less than each of the diameters of the first and second broad sections 228, 230. As a result, the signal contact 122A is movable relative to the tube 206 along the length of the narrow section 226.

The extended position of the signal contact 122A may occur when a shoulder 234 or edge of the first broad section 228 of the signal contact 122A abuts against the indentation 232 of the tube 206, as shown in FIG. 6. The engagement between the shoulder 234 and the indentation 232 retains the signal contact 122A within the tube 206, preventing the coil spring 205 from pushing the signal contact 122A out of the tube 206 through the front end 212. As shown in FIG. 7, the signal contact 122A may achieve the retracted position upon a shoulder 236 or edge of the second broad section 230 of the signal contact 122A abutting against the indentation 232. The signal contact 122A retracts from the extended position towards the retracted position in response to an external force exerted on the signal contact 122A in a rearward direction 238 (opposite the forward direction 215) that overcomes the biasing force exerted on the signal contact 122A by the coil spring 205. For example, mating signal contact 222 (shown in FIG. 9) that engages the signal contact 122A during a mating operation may exert sufficient force on the signal contact 122A to cause the signal contact 122A to retract at least partially towards the retracted position. The retractability of the signal contact 122A ensures a reliable face-to-face electrical connection with the mating signal contact 222 without the risk of stubbing, which could damage the contacts and disrupt the signal transmission.

In the retracted position, the distal end 154 of the signal contact 122A may be recessed from the front end 212 of the tube 206, such that the distal end 154 is axially disposed between the front end 212 and the rear end 214. Alternatively, the distal end 154 of the signal contact 122A may align with the front end 212 of the tube 206 in the retracted position, or may remain outside of the tube 206 in the retracted position although does not project as far from the front end 212 than when in the extended position.

With additional reference to FIG. 4, the end faces 156 of the signal contacts 122 may be contoured, such that the end faces 156 are curved. For example, some of the signal contacts 122 of the electrical connector 102 (shown in FIG. 2) may have end faces 156 that are convex and bow outward, forming a protrusion 250. Other signal contacts 122 may have end faces 156 that are concave and bow inward, forming a depression 252. In the illustrated embodiment, the end faces 156 of the two signal contacts 122 in the pair 132 are different from each other. For example, the end face 156 of the first signal contact 122A is concave, and the end face 156 of the second signal contact 122B is convex. The curved end faces 156 may reduce electrical contact resistance at the contact interface and ensure a reliable electrical connection because the end faces 156 are able to nest with the corresponding mating signal contacts 222 (shown in FIG. 9). The nesting of the contacts 122, 222 may increase the contact surface area between the contacts 122, 222 and may reduce the likelihood of the contacts 122, 222 misaligning relative to the face-to-face contacts 122, 222 having planar contact faces.

The pair 132 of signal contacts 122 shown in FIG. 4 may be representative of all of the pairs 132 of signal contacts 122 of the electrical connector 102 (shown in FIG. 2). For example, each of the pairs 132 of signal contacts 122 may have one signal contact 122 that has a convex end face 156 and one signal contact 122 that has a concave end face 156. In an alternative embodiment, the signal contacts 122 in each pair 132 may have the same type of curved end faces 156, and the curves of the end faces 156 of different pairs 132 may differ. For example, one pair 132 may have concave end faces 156 that define the depressions 252, and an adjacent pair 132 may have convex end faces 156 including protrusions 250.

As shown in FIG. 4, the electrical cable 106 may be a twin-axial cable that includes two core conductors 202. The core conductors 202 are electrically conductive and are able to convey differential signals. The core conductors 202 are surrounded by an insulation layer 260, which extends between and electrically insulates the two core conductors 202 from each other. The insulation layer 260 is surrounded by a shield layer 150, which provides electrical shielding and an electrical ground path along the length of the cable 106. The shield layer 150 may be a metal braid, a foil, a conductive tape, or the like. The electrical cable 106 is prepared such that a distal tip 262 of each of the core conductors 202 projects beyond the insulation layer 260 and the shield layer 150. Each of the distal tips 262 extends through the rear end 214 of a different corresponding tube 206 within the contact unit 140. The tubes 206 and the coil springs 205 are electrically conductive. The distal tips 262 of the core conductors 202 are electrically connected to the signal contacts 122 via the tubes 206 and the coil springs 205. For example, the tubes 206 may be crimped, welded, or the like onto the distal tips 262 to secure the distal tips 262 within the tubes 206. The coil springs 205 may be compressed between the distal tips 262 of the core conductors 202 and the signal contacts 122 to exert the biasing force on the signal contacts 122. Optionally, the contact sub-assemblies 210 may include an additional conductive member within the tubes 206 to electrically connect the signal contacts 122 to the core conductors 202.

The conductive shield member 146 of the contact unit 140 may surround at least a portion of the electrical cable 106. For example, as shown in FIG. 4, the conductive shield member 146 projects rearward beyond the dielectric body 144 and the tubes 206 and surrounds a length of the cable 106. The conductive shield member 146 may engage the shield layer 150 of the cable 106, which electrically commons the shielding and grounding components.

In an embodiment, the dielectric body 144 of the contact unit 140 is designed to have the same or a similar dielectric material property, size, and/or shape as the insulation layer 260 of the electrical cable 106 to limit the extent of impedance change across the interface between the cable 106 and the contact unit 140. For example, the cross-sectional size of the dielectric body 144 may be approximately equal (e.g., within a tolerance range of 5%, 10%, or 15%) to the size of the insulation layer 260. The dielectric body 144 may include an insulative material that is the same or similar to the material of the insulation layer 260, such that the dielectric constants of the two materials are within a designated range (e.g., 0.5 or 1.0) of each other. Limiting the extent of impedance change along the length of the conductive signal path may reduce signal attenuation and degradation, allowing for greater signal transmission throughput (e.g., increased signal speeds and quality).

Figure 8:
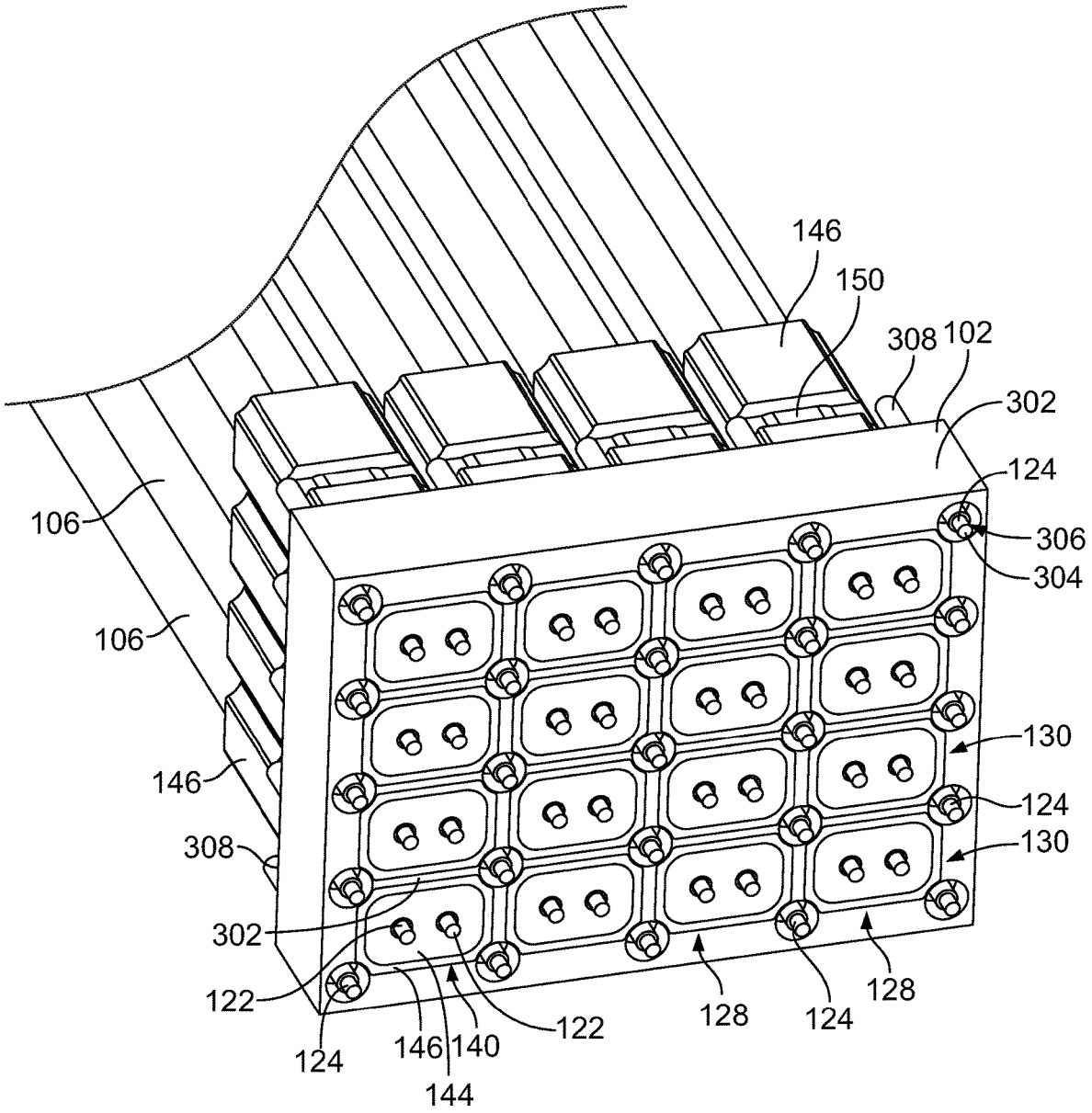
FIG. 8 is a front perspective view of the first electrical connector with a housing omitted.

FIG. 8 is a front perspective view of the electrical connector 102 with the housing 108 omitted. The electrical connector 102 may include a conductive holder 302 disposed within the cavity 120 of the housing 108. The conductive holder 302 surrounds and engages the contact units 140 to secure the contact units 140 in place relative to each other and relative to the housing 108. The conductive holder 302 may extend between adjacent contact units 140 to space the contact units 140 apart. The conductive holder 302 is composed of an electrically conductive material, and engages the conductive shield members 146 of the contact units 140 to electrically common the shield members 146 of different contact units 140 together. The conductive material of the holder 302 optionally may be composed of the same conductive material as the conductive shield members 146, although may be formed independently from the conductive shield members 146. For example, the conductive shield member 146 may be an ICP material or a lossy dielectric material.

According to at least one embodiment, the conductive holder 302 is overmolded around the contact units 140, such that the conductive holder 302 is formed in-situ on the contact units 140. The overmolding may occur after the contact units 140 are loaded into the housing 108, such that the conductive material may be flowed into the cavity 120 and the interstices between adjacent contact units 140 in a liquid or semi-liquid phase and allowed to solidify. The conductive material of the holder 302 may be a hot meld adhesive or a high pressure overmolded material. Alternatively, the conductive material may be overmolded around the contact units 140 remote from the housing 108, and the completed unit may subsequently be inserted into the cavity 120 of the housing 108. In another alternative embodiment, the conductive holder 302 may include a metal material that is die cast or otherwise formed discretely from the contact units 140 (instead of in-situ), such as in the embodiment described below with reference to FIGS. 17 and 18.

In the illustrated embodiment, the ground contacts 124 of the electrical connector 102 are held by the conductive holder 302. The ground contacts 124 are disposed between the columns 128 and the rows 130 of the signal contacts 122 in the illustrated embodiment. The ground contacts 124 are electrically connected to the conductive holder 302, such that the ground contacts 124, the conductive holder 302, the conductive shield members 146, and the shield layers 150 of the cables 106 may all be electrically commoned at the same potential. The ground contacts 124 may be embedded within the conductive holder 302. For example, the conductive holder 302 may be overmolded around the ground contacts 124 as well as the contact units 140.

The ground contacts 124 are pins that have end faces 304 at distal ends 306 of the pins. In an embodiment, the ground contacts 124 may be the same or similar to the signal contacts 122. For example, each of the ground contacts 124 may be held within a tube 308 (also shown in FIG. 9) and moveable within the tube 308 between an extended and a retracted position. The tube 308 also contains a coil spring biasing element (not shown) that exerts a biasing element on the corresponding ground contact 124 to force the ground contact 124 towards the extended position. In an embodiment, the tubes 308 may be replicas or copies of the tubes 206, the ground contacts 124 replicas of the signal contacts 122, and the coil spring biasing elements within the tubes 308 replicas of the coil springs 205, such that the same components are utilized. Unlike the signal contacts 122, the ground contacts 124 and the tubes 308 are not electrically connected to the core conductors 202 (shown in FIG. 4) of the cables 106.

Figure 9:
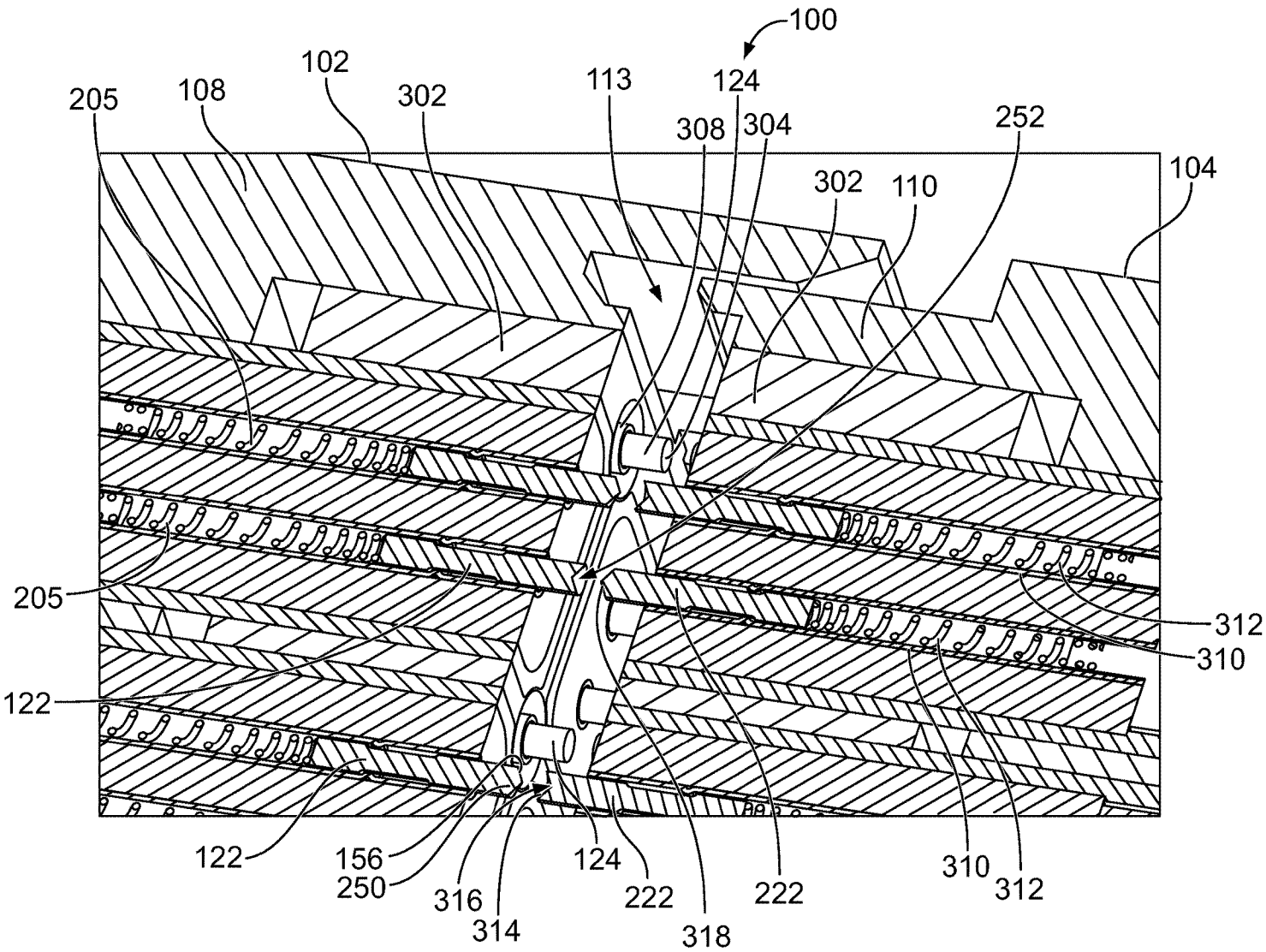
FIG. 9 is a cross-sectional view of a portion of the connector system showing the first electrical connector poised for mating to the second electrical connector according to the embodiment shown in FIGS. 1 through 8.

FIG. 9 is a cross-sectional view of a portion of the connector system 100 showing the first electrical connector 102 poised for mating to the second electrical connector 104 according to the embodiment shown in FIGS. 1 through 8. As described with reference to FIG. 1, the first and second electrical connectors 102, 104 may be hermaphroditic replicas of one another. Thus, the second electrical connector 104 includes mating signal contacts 222 that are retractable within tubes 310 and biased via coil springs 312 within the tubes 310, similar to the signal contacts 122 of the first electrical connector 102. The mating signal contacts 222 are complementary to the signal contacts 122. The end faces 156 of the signal contacts 122 of the first connector 102 are configured to abut against end faces 314 of the mating signal contacts 222 of the second (or mating) connector 104. The connectors 102, 104 are not fully mated in FIG. 9, so the end faces 156 are slightly spaced apart from the end faces 314. When the connectors 102, 104 are fully mated, the end faces 156 nest with the end faces 314. For example, the protrusions 250 of the convex end faces 156 are received within depressions 316 of the concave end faces 314. Protrusions 318 of the convex end faces 314 are received within the depressions 252 of the concave end faces 156.

The electrical connectors 102, 104 are designed such that the signal contacts 122, 222 engage one another during the mating operation prior to the housings 108, 110 reaching a fully mated position. After the signal contacts 122, 222 make initial contact, the additional movement of the connectors 102, 104 in the mating direction causes the signal contacts 122, 222 to partially retract away from the mating interface 113 while maintaining face-to-face engagement. The coil springs 205, 312 compress to accommodate the movement of the respective signal contacts 122, 222. When the connectors 102, 104 are fully mated, each set of complementary connected signal contacts 122, 222 achieves an equilibrium position between the coil springs 205, 312 based on the relative stiffness of the springs 205, 312.

The end faces 304 of the ground contacts 124 of the first electrical connector 102 are configured to abut against end faces of ground contacts of the second connector 104, which are not visible in FIG. 9. The ground contacts 124 may nest with the complementary ground contacts of the second connector 104, similar to the nesting of the signal contacts 122, 222. The two ground contacts 124 of the first connector 102 that are visible in FIG. 9 both have concave end faces 304, but it is recognized that optionally some of the end faces 304 may be convex. The engagement between the ground contacts 124 of the first connector 102 and the complementary ground contacts of the second connector 104 electrically connects the ground references of the connectors 102, 104. Thus, even if the conductive holder 302 of the first connector 102 does not abut against a similar conductive holder 302 of the second connector 104 when fully mated, the ground contacts ensure that the ground references are electrically connected across the mating interface 113.

Figure 10:
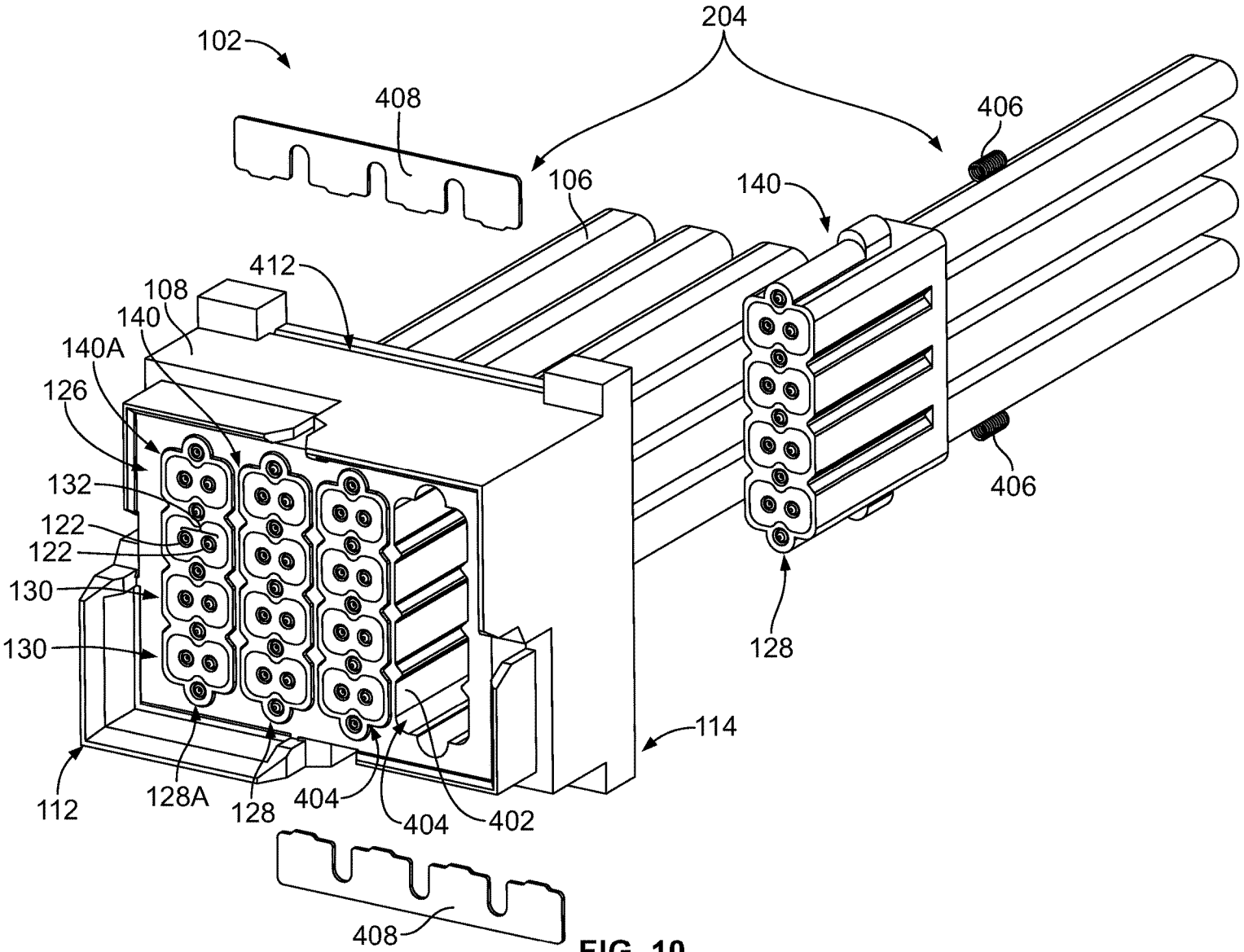
FIG. 10 is an exploded perspective view of the first electrical connector of the connector system according to a second embodiment.

FIG. 10 is an exploded perspective view of the first electrical connector 102 of the connector system 100 according to another embodiment. The signal contacts 122 are arranged in pairs 132 and organized in the array 126 of columns 128 and rows 130, similar to the embodiment shown in FIG. 2. The electrical connector 102 includes multiple contact units 140 that hold the signal contacts 122. Unlike the embodiment shown in FIG. 2, each contact unit 140 holds an entire column 128 of the signal contacts 122. For example, the connector 102 in the illustrated embodiment has four contact units 140, and each contact units 140 holds a different one of the four columns 128 of signal contacts 122. The contact units 140 are stacked side by side within the housing 108. Optionally, the housing 108 has partition walls 402 that define multiple individual cavities 404. Each of the cavities 404 extends from the mating end 112 of the housing 108 to the back end 114.

In the illustrated embodiment, the signal contacts 122 are rigidly held within the contact units 140, such that the signal contacts 122 are not retractable relative to the contact unit 140 holding the signal contacts 122. Each contact unit 140 is retractable relative to the housing 108 and the other contact units 140. The signal contacts 122 are movable between an extended position and a retracted position with the movement of the contact unit 140 that holds the signal contacts 122. For example, a first contact unit 140A that holds the signal contacts 122 in a first column 128A is independent retractable relative to the housing 108 and the other contact units 140. As the contact unit 140A moves, the signal contacts 122 in the first column 128A move with the contact unit 140A. The signal contacts 122 in the first column 128A are collectively retractable as a group, but are not individually retractable relative to one another.

The contact units 140 are forced towards the extended position by one or more biasing elements 204. In the illustrated embodiment, the biasing elements 204 include coil springs 406 and contact plates 408. The contact plates 408 are configured to be secured to the housing 108. For example, the contact plates 408 may be loaded into slots 412 of the housing 108. When the connector 102 is assembled, the coil springs 406 are disposed between the contact plates 408 and the contact units 140. The coil springs 406 exert a biasing force on the contact units 140 towards the extended position.

Figure 11:
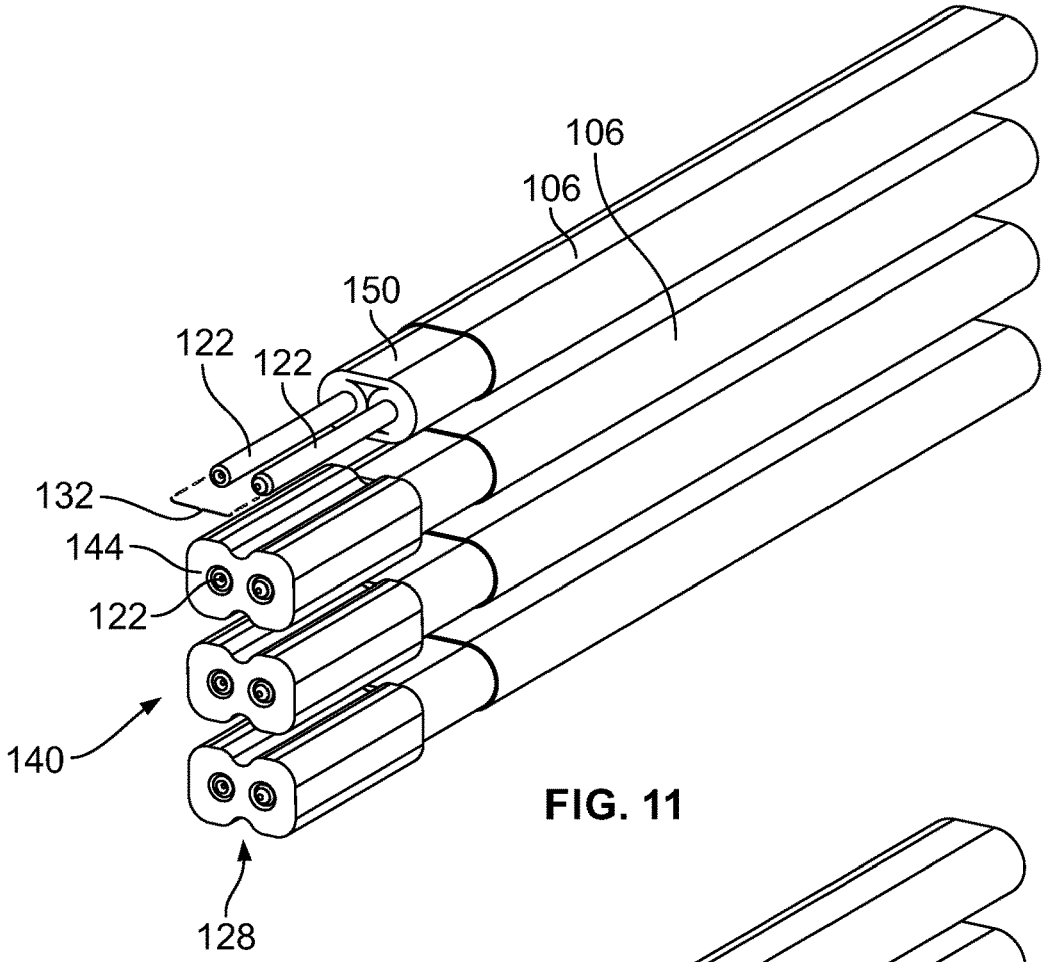
FIG. 11 illustrates one of the contact units of the first electrical connector according to the embodiment shown in FIG. 10 at an intermediate stage in the assembly of the contact unit.
Figure 12:
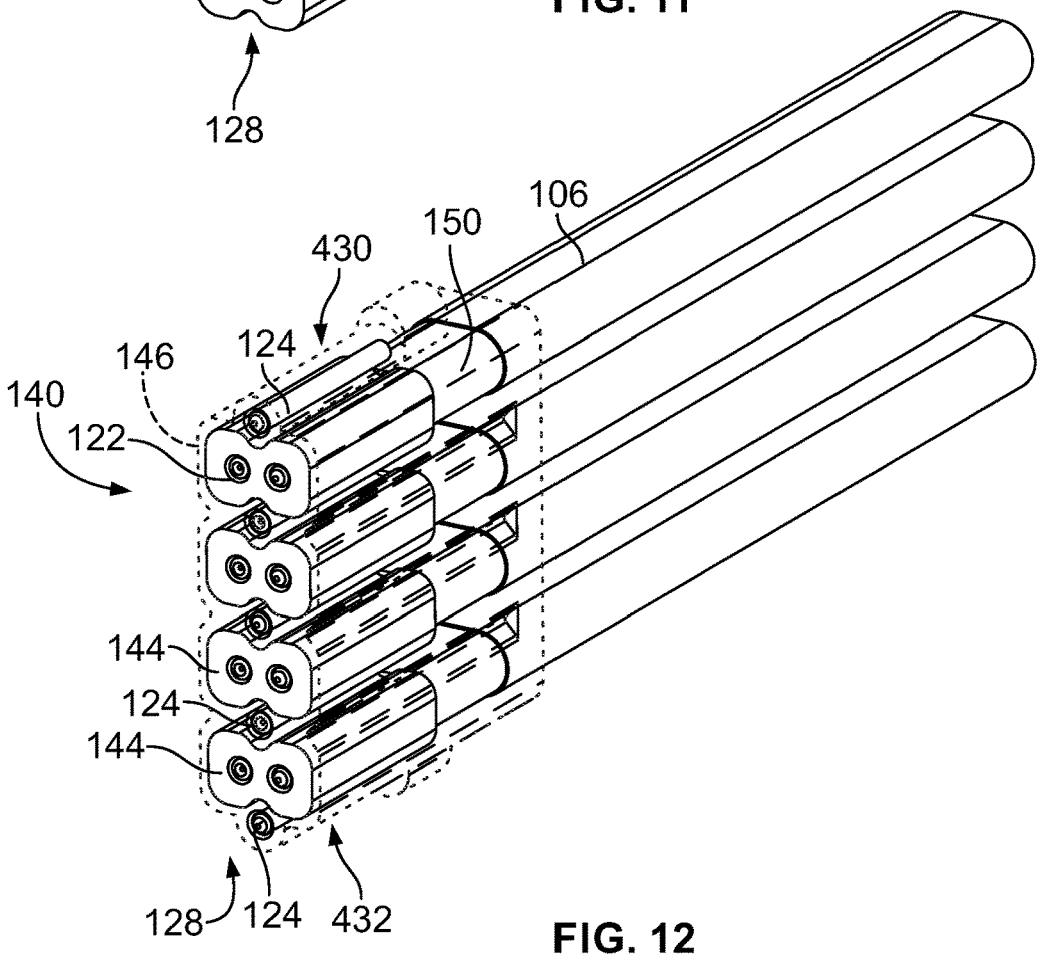
FIG. 12 illustrates the contact unit of FIG. 11 in a completed assembly stage with a conductive shield member of the contact unit shown in phantom.

FIG. 11 illustrates one of the contact units 140 of the electrical connector 102 according to the embodiment shown in FIG. 10 at an intermediate stage in the assembly of the contact unit 140. FIG. 12 illustrates the contact unit 140 of FIG. 11 in a completed stage with a conductive shield member 146 of the contact unit 140 shown in phantom.

FIG. 11 shows four twin-axial electrical cables 106 that are each electrically terminated to a different pair 132 of the signal contacts 122. The signal contacts 122 in the illustrated embodiment are elongated pins that are mechanically attached to corresponding core conductors 202 (shown in FIG. 4) of the cables 106. For example, the pins of the signal contacts 122 may be crimped, welded, soldered, or the like to the core conductors 202. In the illustrated embodiment, the signal contacts 122 are not held within tubes that contain coil springs. After terminating the signal contacts 122 to the cables 106, the dielectric bodies 144 may be formed in-situ on the signal contacts 122 to surround and electrically insulate the signal contacts 122. Each of the dielectric bodies 144 surrounds a different pair 132 of the contacts 122. The pair 132 of signal contacts 122 at the top of the column 128 is not surrounded by a dielectric body 144 in FIG. 11 merely for descriptive purposes to show the shape of the contacts 122. As shown in FIG. 11, the shield layers 150 of the cables 106 are exposed along segments of the cables 106 rearward of the dielectric bodies 144.

Referring to FIG. 12, the conductive shield member 146 of the contact unit 140 may be overmolded onto the cables 106 and the dielectric bodies 144. In the illustrated embodiment, the contact unit 140 has multiple (e.g., four) dielectric bodies 144 and only one conductive shield member 146. The conductive shield member 146 engages, surrounds, and extends between the dielectric bodies 144. The conductive shield member 146 also engages the shield layers 150 of the cables 106 to electrically connect the shield member 146 with the shield layers 150.

In the illustrated embodiment, the contact unit 140 holds ground contacts 124 of the electrical connector 102. For example, the ground contacts 124 may be held by (e.g., embedded within) the conductive shield member 146. The conductive shield member 146 functions to secure the ground contacts 124 and the dielectric bodies 144 (with the signal contacts 122 therein) in fixed positions. Due to the conductive shield member 146, the entire sub-assembly including the contact unit 140, the signal contacts 124, the ground contacts 124, and the cables 106, moves as a single unit within the housing 108 (shown in FIG. 10). In the illustrated embodiment, the ground contacts 124 are between the dielectric bodies 144 in the column 128, as well as at both top and bottom ends 430, 432 of the contact unit 140. The ground contacts 124 are elongated pins, and may be the same or similar to the signal contacts 122.

Figure 13:
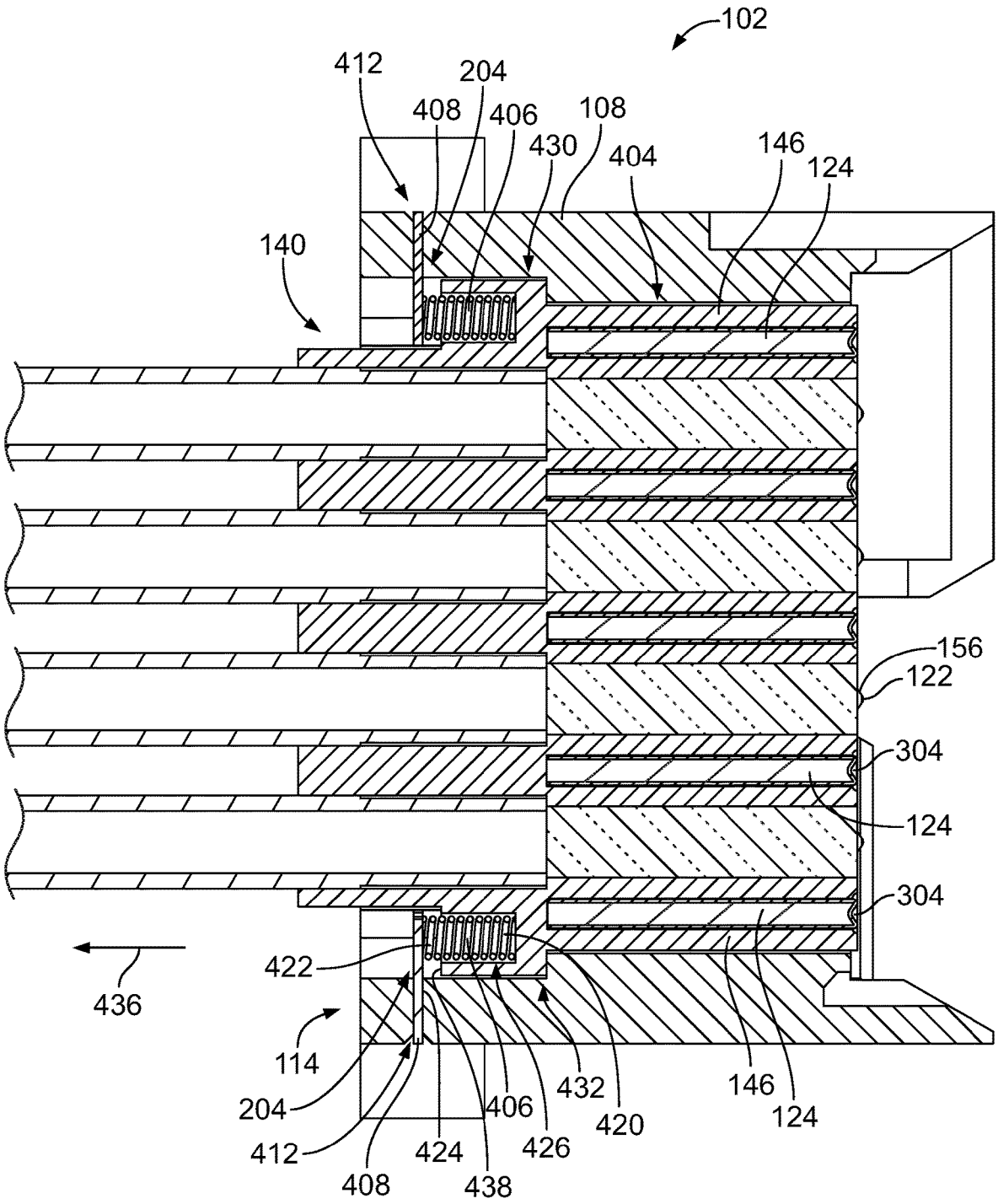
FIG. 13 is a side cross-sectional view of the first electrical connector according to the embodiment shown in FIGS. 10 through 12.

FIG. 13 is a side cross-sectional view of the electrical connector 102 according to the embodiment shown in FIGS. 10 through 12. The cross-section line bisects one of the contact units 140, such that the line extends through the ground contacts 124 held by the conductive shield member 146. The contact unit 140 is held in one of the cavities 404 of the housing 108.

In the illustrated embodiment, the slots 412 that receive the contact plates 408 of the biasing elements 204 are located proximate to the back end 114 of the housing 108. After the contact unit 140 and coil springs 406 are loaded into the cavity 404, the contact plates 408 may be inserted into the slots 412 such that portions of the contact plates 408 overlap portions of the contact unit 140. For example, the contact plates 408 project into a pull-out path of the contact unit 140. The coil springs 406 are assembled between the contact plates 408 and the contact unit 140. For example, a first end 420 of each coil spring 406 engages the contact unit 140, and a second end 422 of the coil spring 406 (opposite the first end 420) engages a front side 424 of the corresponding contact plate 408. In the illustrated embodiment, the first ends 420 of the coil springs 406 are received within apertures 426 of the conductive shield member 146.

The contact unit 140 in FIG. 13 is in the extended position. The contact unit 140 is biased towards the extended position by the two biasing elements 204, which are located at the top and bottom ends 430, 432 of the contact unit 140 to impart a balanced biasing force on the contact unit 140. The end faces 304 of the ground contacts 124 and the end faces 156 of the signal contacts 122 of the electrical connector 102 are configured to engage corresponding mating contacts of a mating connector (e.g., the second electrical connector 104) via abutting face-to-face, as described above with reference to FIG. 9. The abutting of the contacts 122, 124 with the mating connector may cause the contact unit 140 to retract at least partially in a rearward direction 436 towards the retracted position. Optionally, the contact unit 140 may be able to retract until the coil springs 406 are fully retracted and form a hard stop that prohibits additional retraction of the contact unit 140.

With additional reference to FIG. 10, each of the four contact units 140 in the illustrated embodiment are biased towards the extended position by biasing elements like the biasing elements 204 shown in FIG. 13. For example, each of the two contact plates 408 extends across the four contact units 140. Each contact unit 140 has two respective coil springs 406 within the apertures 426 of the conductive shield member 146. The coil springs 406 of each of the contact units 140 engage the two contact plates 408 to establish the biasing elements 204 that allow each of the contact units 140 to independently retract relative to the housing 108 and to the other contact units 140.

Figure 14:
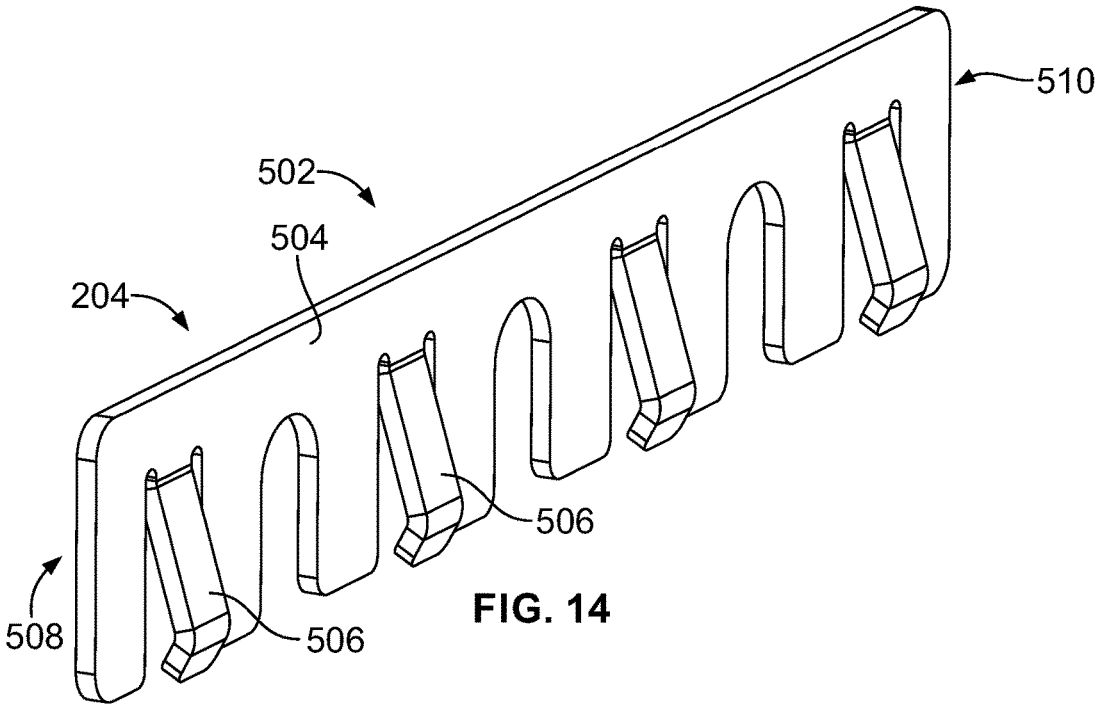
FIG. 14 is an isolated perspective view of a biasing element of the first electrical connector according to another embodiment.
Figure 15:
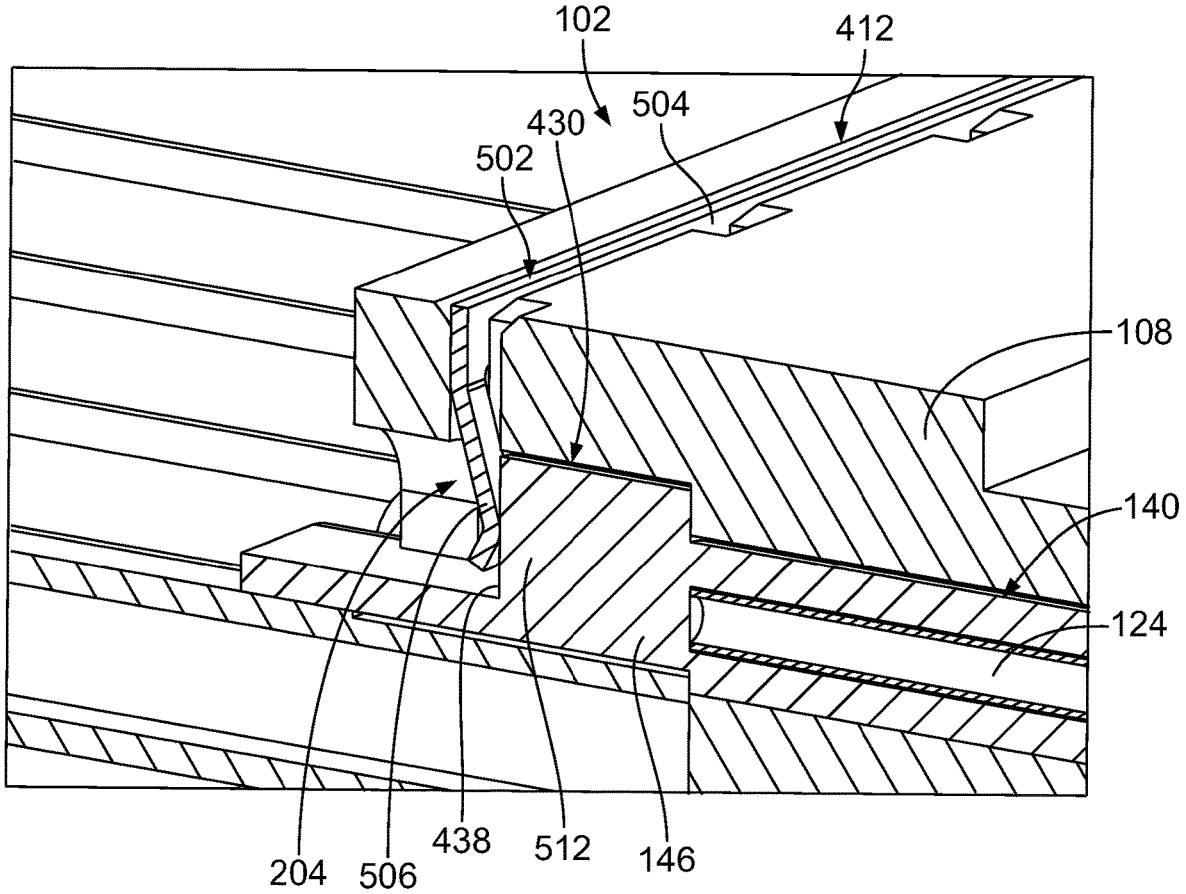
FIG. 15 is a cross-sectional view of a portion of the first electrical connector according to a third embodiment that includes the biasing element shown in FIG. 14.

FIG. 14 is an isolated perspective view of the biasing element 204 of the electrical connector 102 according to another embodiment. FIG. 15 is a cross-sectional view of a portion of the electrical connector 102 according to an embodiment that includes the biasing element 204 shown in FIG. 14. The biasing element 204 in the illustrated embodiment shown in FIGS. 14 and 15 is a spring plate 502 that has a planar body 504 and deflectable spring beams 506 that are cantilevered from the planar body 504. The spring plate 502 is elongated along a length that extends from a first end 508 to a second end 510. The deflectable spring beams 506 are spaced apart from each other along the length. In an embodiment, the spring beams 506 are integral with the planar body 504 such that the spring plate 502 has a unitary, monolithic, one-piece construction. For example, the spring plate 502 may be stamped and formed, with the spring beams 506 cut and bent out of the plane of the body 504.

The spring plate 502 may represent the biasing element 204 in the embodiment of the electrical connector shown in FIGS. 10 through 13, such that the spring plate 502 may replace the contact plate 408 and the coil springs 406 shown in FIGS. 10 and 13. In FIG. 15, the contact unit 140 may be similar to the contact units 140 shown in FIGS. 10 through 13, such that the ground contacts 124 and the signal contacts 122 (shown in FIG. 12) are rigidly held in the contact unit 140. The spring plate 502 is installed into one of the slots 412 of the housing 108. The length of the spring plate 502 may be the same or similar to the length of the contact plates 408, such that the installed spring plate 502 extends across multiple contact units 140. The deflectable spring beams 506 align with different contact units 140. Each spring beam 506 engages the back surface 438 of the conductive shield member 146 of the corresponding contact unit 140 to exert a biasing force on the contact units 140 towards the extended position.

In the illustrated embodiment, the conductive shield member 146 includes a lug 512 at the top end 430 of the contact unit 140. The lug 512 defines the back surface 438 that is contacted by the spring beam 506. The lug 512 may be a protrusion. The lug 512 is solid in FIG. 15, but may be hollowed out to define the aperture 426 that receives the coil spring 406 in the embodiment shown in FIGS. 10 through 13. For example, the lack of the aperture 426 in the conductive shield member 146 may represent the only difference between the contact unit 140 shown in FIG. 15 and the contact unit 140 in the embodiment shown in FIGS. 10 through 13. Although only one spring plate 502 is shown in FIG. 15 that engages the contact unit 140 at the top end 430, the electrical connector 102 may include at least another spring plate 502 that engages the contact unit 140 at or proximate to the bottom end 432, as shown in FIG. 13.

Figure 16:
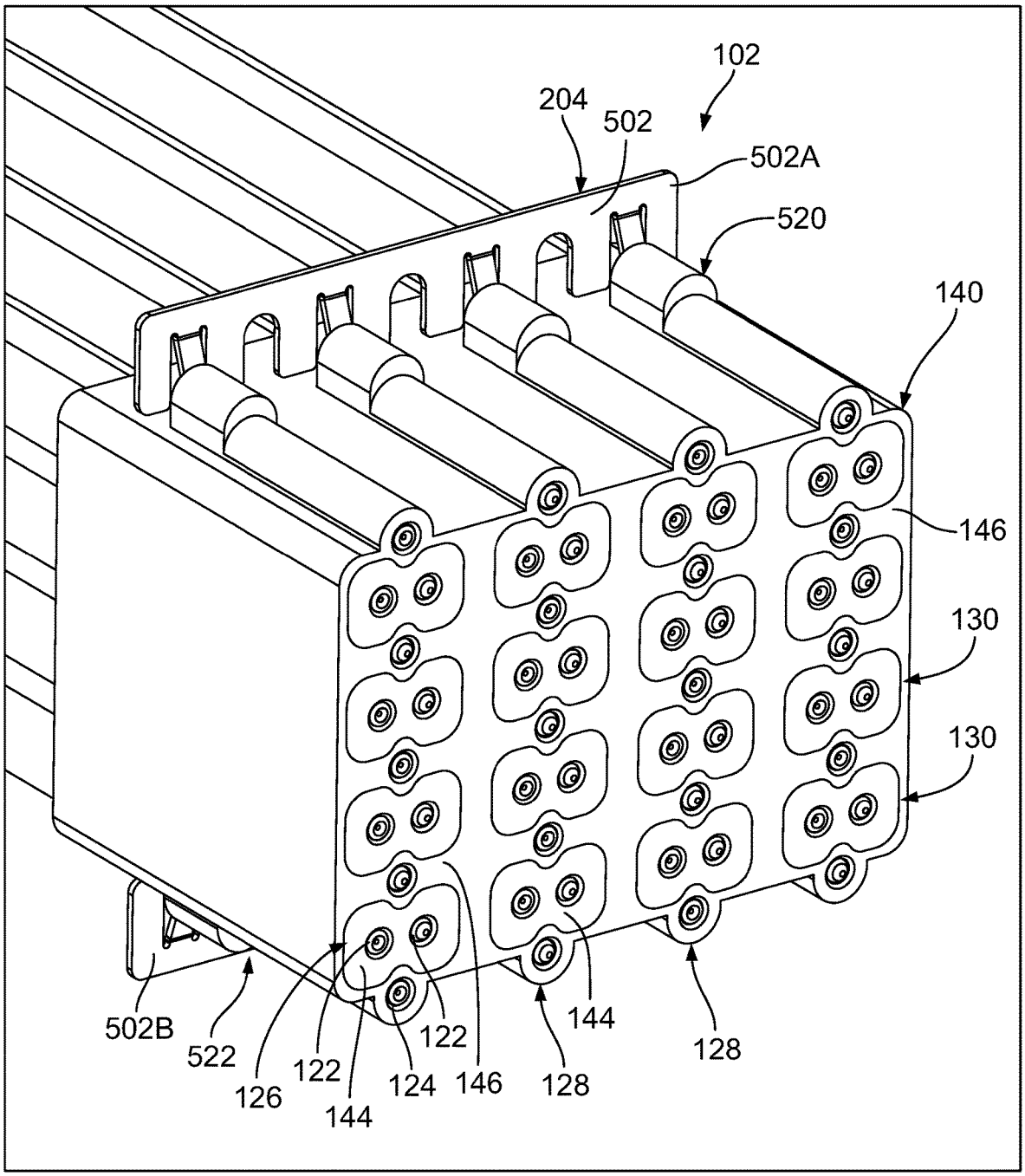
FIG. 16 is a front perspective view of the first electrical connector according to a fourth embodiment shown with the housing omitted.

FIG. 16 is a front perspective view of the electrical connector 102 according to another embodiment shown with the housing 108 omitted. In the illustrated embodiment, the signal contacts 122 are organized in the array 126 of columns 128 and rows 130. The illustrated embodiment is a variation of the embodiments shown in FIGS. 10 through 15. Instead of multiple contact units 140, the electrical connector 102 according to the illustrated embodiment has a single contact unit 140 that holds all of the signal contacts 122. The single contact unit 140 also holds all of the ground contacts 124. The signal contacts 122 and ground contacts 124 in the illustrated embodiment are rigidly fixed to the single contact unit 140. The entire contact unit 140 is retractable relative to the housing 108. Although the housing 108 is not shown, the housing 108 may be the same or similar to the housing 108 shown in FIG. 2, such that the housing 108 defines a single cavity 120 (shown in FIG. 2) that accommodates the contact unit 140. The single contact unit 140 may be formed similar to the contact units 140 shown in FIGS. 10 and 11, except that the conductive shield member 146 is overmolded over all of the dielectric bodies 144 in the array 126 instead of only the dielectric bodies 144 in one column 128.

In the illustrated embodiment, all of the signal contacts 122 and ground contacts 124 are collectively retractable relative to the housing 108 as a group. The electrical connector 102 includes one or more biasing elements 204 to exert a biasing force on the contact unit 140 towards the extended position. In the illustrated embodiment, the electrical connector 102 has two of the spring plates 502 shown in FIG. 14 that represent the biasing elements 204. One spring plate 502A engages the contact unit 140 along a top end 520 of the contact unit 140, and another spring plate 502B engages the contact unit 140 along a bottom end 522 of the contact unit 140. The signal contacts 122 and ground contacts 124 are configured to engage face-to-face with corresponding contacts of a mating connector, such as the second electrical connector 104 shown in FIGS. 1 and 9, as described above. Although spring plates 502 are shown in FIG. 16, the biasing elements 204 that engage the single contact unit 140 alternatively may be the contact plates 408 and coil springs 406 shown in FIGS. 10 and 13 or another biasing element.

Figure 17:
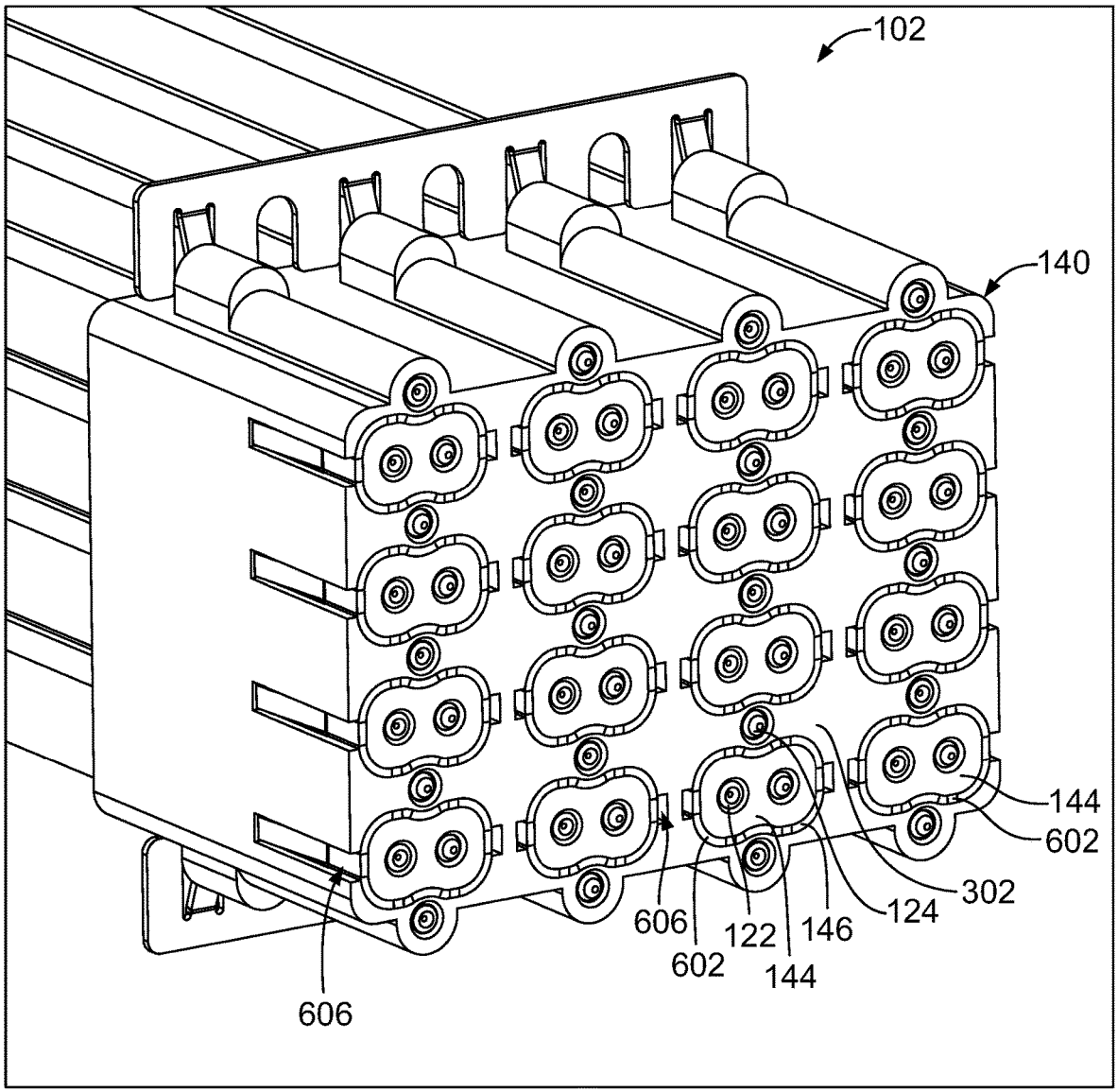
FIG. 17 is a front perspective view of the first electrical connector according to a fifth embodiment shown with the housing omitted.

FIG. 17 is a front perspective view of the electrical connector 102 according to another embodiment shown with the housing 108 omitted. The illustrated embodiment in FIG. 17 is similar to the embodiment shown in FIG. 16, such that there is a single contact unit 140 that rigidly holds all of the signal contacts 122 and ground contacts 124, and the contact unit 140 pistons between the extended position and the retracted position to allow for reliable face-to-face mating of the contacts 122, 124 with a mating connector without stubbing. FIG. 17 differs from FIG. 16 in the composition and formation of the contact unit 140. For example, instead of a single conductive shield member 146 that is overmolded around all of the dielectric bodies 144 as shown in FIG. 16, the contact unit 140 in FIG. 17 has multiple discrete conductive shield members 146 that each surrounds a different one of the dielectric bodies 144. The conductive shield members 146 in the illustrated embodiment are ground ferrules 602 that are separately formed and discrete from the bodies 144. The contact unit 140 also includes a conductive holder 302 that surrounds and holds the ground ferrules 602. In the illustrated embodiment, the conductive holder 302 includes one or more metals and is formed via a die-cast molding process. The conductive holder 302 is formed remote and discrete from the other components of the contact unit 140.

Figure 18:
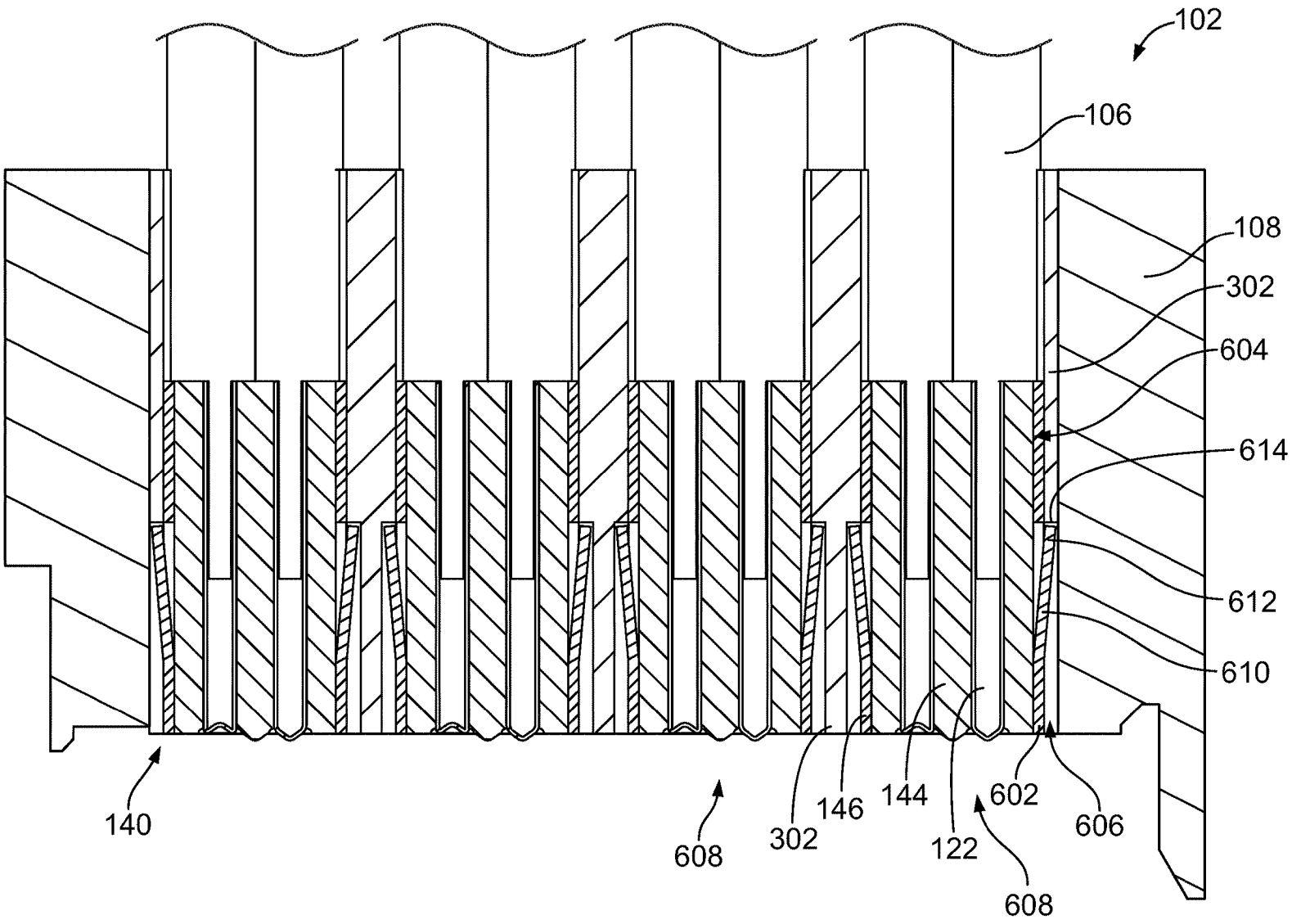
FIG. 18 shows a top-down cross-sectional view of the first electrical connector including the housing according to the embodiment shown in FIG. 17.

FIG. 18 shows a top-down cross-sectional view of the electrical connector 102 including the housing 108 according to the embodiment shown in FIG. 17. In an embodiment, the contact unit 140 is assembled by die-casting or otherwise molding the conductive holder 302 to include multiple channels 604 and side pockets 606 (also shown in FIG. 17). Separately, sub-assemblies 608 are assembled which include the signal contacts 122, the dielectric bodies 144, the cables 106, and the ground ferrules 602 that represent the conductive shield members 146. The sub-assemblies 608 are then loaded into corresponding channels 604 in the conductive holder 302. The ground ferrules 602 may have deflectable locking latches 610 that project laterally outward from the ground ferrules 602. The locking latches 610 may deflect inward as the sub-assemblies 608 are loaded through the channels 604. When the sub-assemblies 608 reach a fully loaded position, the locking latches 610 fully align with the side pockets 606 and resile outward into the corresponding side pockets 606. Engagement between distal ends 612 of the locking latches 610 and catch surfaces 614 of the conductive holder 302 may lock the sub-assemblies 608 within the channels 604 of the conductive holder 302.

Although the electrical connectors 102, 104 in the embodiments shown and described herein are cable-mounted to the electrical cables 106, one or both of the connectors 102, 104 may be terminated to a circuit board or another device in an alternative embodiment. Furthermore, the housings 108, 110 may be mountable to panels, circuit boards, or other structures.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing extends from a mating end to a back end of the housing;

electrical signal contacts terminated to one or more electrical cables that project from the back end of the housing, the signal contacts held by one or more contact units within the housing, the signal contacts movable relative to the housing between an extended position and a retracted position, the retracted position disposed closer to the back end of the housing than the extended position; and biasing elements configured to bias the signal contacts toward the extended position, wherein the signal contacts are pins with an end face at a distal end of each respective pin, the end faces of a first subset of the signal contacts are concave, and the end faces of a second subset of the signal contacts are convex, the concave and convex end faces of the signal contacts configured to abut against and nest with complementary-shaped end faces of corresponding mating signal contacts of a mating connector.

2. The electrical connector of claim 1, wherein the biasing elements are coil springs housed within tubes that have front ends and rear ends, the electrical cables including conductors extending into the rear ends of the tubes, each of the signal contacts held within a different one of the tubes at the front end thereof such that the coil springs are disposed between the conductors and the signal contacts.

3. The electrical connector of claim 1, wherein the signal contacts are rigidly held by the one or more contact units and the biasing elements include coil springs and contact plates, the contact plates disposed within slots in the housing, the coil springs having a first end mounted to the one or more contact units and a second end engaging a front side of the contact plates to bias the one or more contact units and the signal contacts toward the extended position.

4. The electrical connector of claim 1, wherein the signal contacts are rigidly held by the one or more contact units and the biasing elements include spring plates disposed within slots in the housing, the spring plates having integral deflectable spring beams that engage lugs of the one or more contact units to bias the one or more contact units and the signal contacts toward the extended position.

5. The electrical connector of claim 1, wherein the electrical cables are twin-axial cables that each includes two core conductors and the signal contacts are arranged in pairs such that each pair is electrically connected to the core conductors of a different one of the electrical cables, wherein the end face of one of the signal contacts in each pair is concave and the end face of the other signal contact in each pair is convex.

6. The electrical connector of claim 1, wherein the electrical cables are twin-axial cables that each includes two core conductors and an insulation layer surrounding the core conductors, wherein the one or more contact units includes multiple dielectric bodies, each dielectric body surrounding a corresponding pair of the signal contacts electrically connected to the two core conductors of one of the electrical cables, wherein the dielectric bodies have a cross-sectional size approximately equal to the insulation layers of the electrical cables.

7. The electrical connector of claim 1, wherein the signal contacts are organized in an array including multiple columns, wherein the one or more contact units includes multiple contact units that each holds a different column of the signal contacts.

8. The electrical connector of claim 1, wherein the signal contacts are organized in an array including multiple columns, wherein the one or more contact units includes a single contact unit that holds all of the signal contacts in the array.

9. The electrical connector of claim 1, further comprising electrical ground contacts held within the housing, wherein the ground contacts are movable relative to the housing between the extended and retracted positions, and the biasing elements are configured to bias the ground contacts toward the extended position.

10. The electrical connector of claim 1, wherein the one or more contact units includes multiple dielectric bodies and one or more conductive shield members, each of the dielectric bodies surrounding a corresponding pair of the signal contacts, each of the one or more conductive shield members surrounding at least one of the dielectric bodies and engaging a shield layer of at least one of the electrical cables.

11. The electrical connector of claim 10, further comprising electrical ground contacts held by the one or more conductive shield members, the ground contacts being pins with an end face at a distal end of each respective pin, the end face of each ground contact configured to abut against an end face of a corresponding mating ground contact of the mating connector.

12. The electrical connector of claim 10, further comprising a conductive holder disposed within the housing, the conductive holder surrounding the one or more contact units and engaging the conductive shield members thereof to secure the one or more contact units in place within the housing.

13. The electrical connector of claim 12, further comprising electrical ground contacts held by the conductive holder, the ground contacts being pins with an end face at a distal end of each respective pin, the end face of each ground contact configured to abut against an end face of a corresponding mating ground contact of the mating connector.

14. An electrical connector comprising:

a housing;

electrical signal contacts arranged in pairs, each pair of the signal contacts being terminated to core conductors of a different one of multiple electrical cables projecting from the housing, the pairs of signal contacts organized in an array including multiple columns;

one or more contact units within the housing, the one or more contact units including multiple dielectric bodies and one or more conductive shield members, each of the dielectric bodies surrounding a different one of the pairs of the signal contacts, each of the one or more conductive shield members surrounding at least one of the dielectric bodies and engaging a shield layer of at least one of the electrical cables;

electrical ground contacts held within the housing, wherein the signal contacts and the ground contacts are movable relative to the housing between an extended position and a retracted position, the retracted position disposed closer to a back end of the housing than the extended position; and biasing elements configured to bias the signal contacts and the ground contacts toward the extended position, wherein the signal contacts and the ground contacts are pins that have an end face at a distal end of each respective pin, the end faces of the signal contacts configured to abut against end faces of corresponding mating signal contacts of a mating connector, the end faces of the ground contacts configured to abut against end faces of corresponding mating ground contacts of the mating connector.

15. The electrical connector of claim 14, wherein the end face of one of the signal contacts in each pair is concave and the end face of the other signal contact in each pair is convex.

16. The electrical connector of claim 14, wherein the dielectric bodies have a cross-sectional size approximately equal to insulation layers of the electrical cables that surround the core conductors.

17. The electrical connector of claim 14, wherein the ground contacts are held by the one or more conductive shield members of the one or more contact units.

18. An electrical connector comprising:

a housing;

electrical signal contacts arranged in pairs and held by one or more contact units within the housing, the one or more contact units including multiple dielectric bodies and one or more conductive shield members, each of the dielectric bodies surrounding a different one of the pairs of the signal contacts, each of the one or more conductive shield members surrounding at least one of the dielectric bodies, wherein the signal contacts are movable relative to the housing between an extended position and a retracted position, the retracted position disposed closer to a back end of the housing than the extended position;

electrical ground contacts held by the one or more conductive shield members; and biasing elements configured to bias the signal contacts toward the extended position, wherein the signal contacts and the ground contacts are pins with an end face at a distal end of each respective pin, the end faces of the signal contacts configured to abut against end faces of corresponding mating signal contacts of a mating connector, the end faces of the ground contacts configured to abut against end faces of corresponding mating ground contacts of the mating connector.

19. The electrical connector of claim 18, wherein the biasing elements are coil springs housed within tubes, each of the signal contacts held within a different one of the tubes at a front end thereof and engaged by the coil spring therein such that the signal contacts are individually biased in the extended position.

20. The electrical connector of claim 18, wherein the signal contacts are rigidly held by the one or more contact units and the biasing elements include coil springs and contact plates, the contact plates disposed within slots in the housing, the coil springs having a first end engaging the one or more contact units and a second end engaging a front side of the contact plates to bias the one or more contact units and the signal contacts toward the extended position.

21. The electrical connector of claim 18, wherein the signal contacts are rigidly held by the one or more contact units and the biasing elements include spring plates disposed within slots in the housing, the spring plates having integral deflectable spring beams that engage lugs of the one or more contact units to bias the one or more contact units and the signal contacts toward the extended position.

22. The electrical connector of claim 18, wherein the end faces of a first subset of the signal contacts are concave, and the end faces of a second subset of the signal contacts are convex.

* * * * *